US008356653B2

(12) United States Patent
Fu-Lai et al.

(10) Patent No.: US 8,356,653 B2
(45) Date of Patent: Jan. 22, 2013

(54) CONTROL MODULE HAVING A CLUTCH FOR RAISING AND LOWERING A WINDOW SHADE

(75) Inventors: Yu Fu-Lai, Taipei Hsieh (TW); Huang Chin-Tien, Taipei Hsieh (TW)

(73) Assignee: Teh Yor Co., Ltd., Taipei (TW)

( * ) Notice: Subject to any disclaimer, the term of this patent is extended or adjusted under 35 U.S.C. 154(b) by 144 days.

(21) Appl. No.: 12/806,984

(22) Filed: Aug. 25, 2010

(65) Prior Publication Data

US 2012/0048485 A1 Mar. 1, 2012

(51) Int. Cl.
*A47H 5/00* (2006.01)

(52) U.S. Cl. ..... 160/84.05; 160/170; 160/319

(58) Field of Classification Search ..... 160/84.05, 160/84.01, 84.02, 308, 319, 170
See application file for complete search history.

(56) References Cited

U.S. PATENT DOCUMENTS

| | | | | |
|---|---|---|---|---|
| 5,791,393 | A * | 8/1998 | Judkins | 160/321 |
| 6,129,131 | A * | 10/2000 | Colson | 160/84.02 |
| 6,142,211 | A | 11/2000 | Judkins | |
| 7,275,580 | B2 | 10/2007 | Yu et al. | |
| 7,665,507 | B2 * | 2/2010 | Naoki | 160/308 |
| 2004/0226663 | A1 * | 11/2004 | Smith et al. | 160/84.05 |
| 2007/0023151 | A1 | 2/2007 | Judkins | |
| 2008/0041540 | A1 | 2/2008 | Li | |
| 2008/0179017 | A1 | 7/2008 | Yu et al. | |
| 2009/0120592 | A1 * | 5/2009 | Lesperance | 160/84.02 |
| 2009/0120593 | A1 * | 5/2009 | Lesperance | 160/84.02 |

OTHER PUBLICATIONS

Written Opinion of the International Searching Authority (PCT Rule43bis.1) (Form PCT/ISA/237) for TEH-50 PCT dated Oct. 29, 2010, 6 pages.

International Search Report (PCT Article 18 and Rules 43 and 44) (Form PCT/ISA/210) for TEH-50 PCT dated Oct. 29, 2010, 2 pages.

* cited by examiner

*Primary Examiner* — David Purol
(74) *Attorney, Agent, or Firm* — Olson & Cepuritis, Ltd.

(57) ABSTRACT

A control module may be used for raising and lowering a window shade. This configuration allows a user to pull the operating cord a predetermined distance to raise the window shade, then release the operating cord until it has retracted, and then pull the operating cord another predetermined distance to raise the window shade again. A brake mechanism is operably connected to a brake release and configured to lock or unlock the drive axle. A clutch is adapted to be mounted on the axle for selectively engaging the cord drum to the axle. The cord drum may rotate independent of the drive axle when a clutch is disengaged from the drive axle. As a result, movement of the operating cord will not cause the window shade to raise while the clutch is disengaged. When the clutch is engaged with the drive axle, the cord drum and adapter sleeve may rotate together to drive the rotation of the drive axle for raising the window shade.

21 Claims, 14 Drawing Sheets

Fig. 3
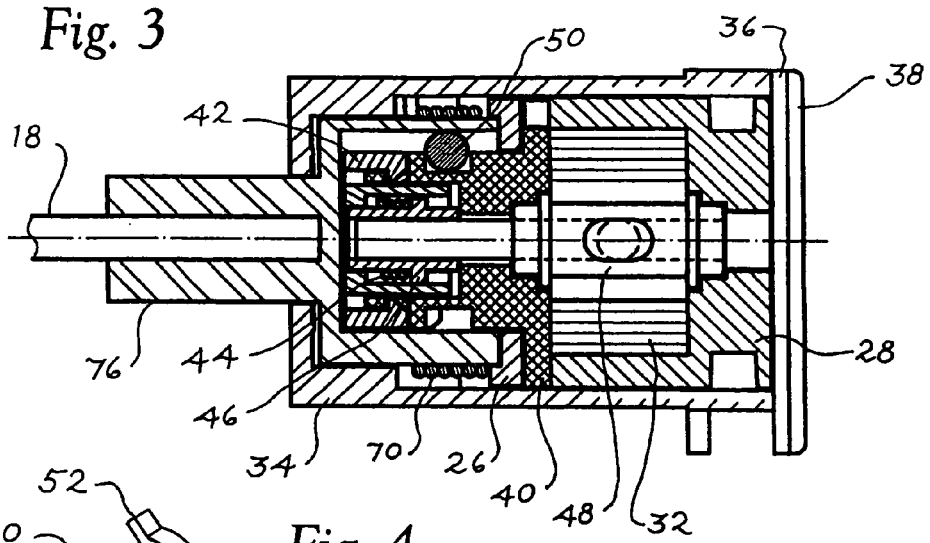
Fig. 4
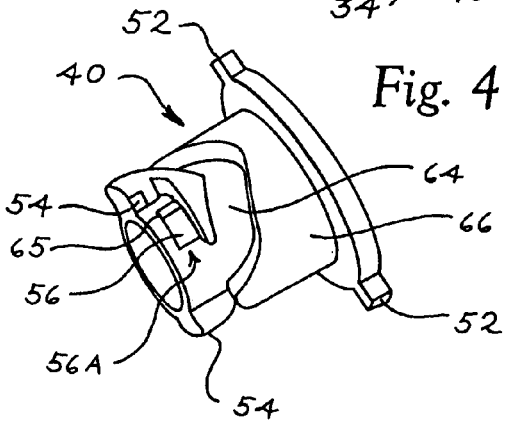
Fig. 5
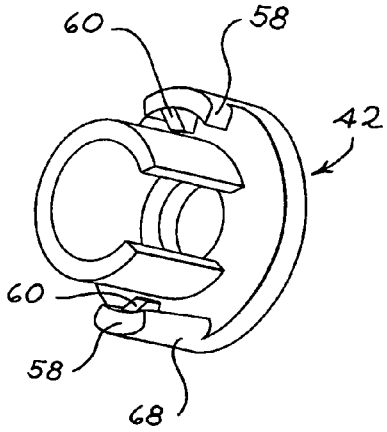
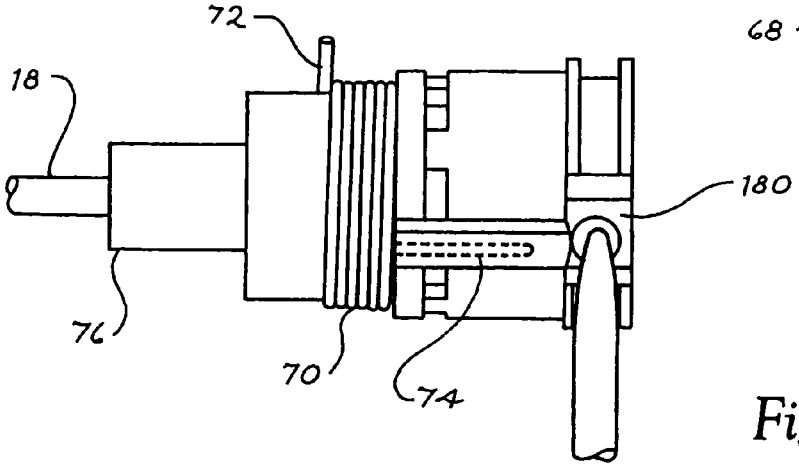
Fig. 6

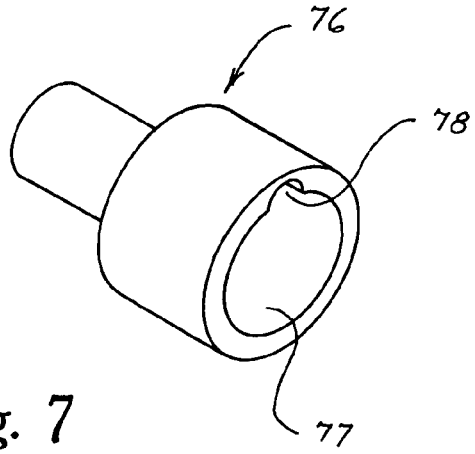
Fig. 7
Fig. 8
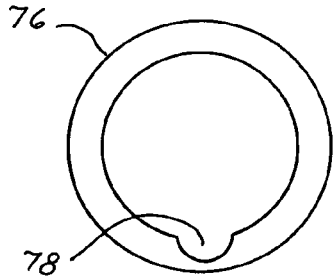
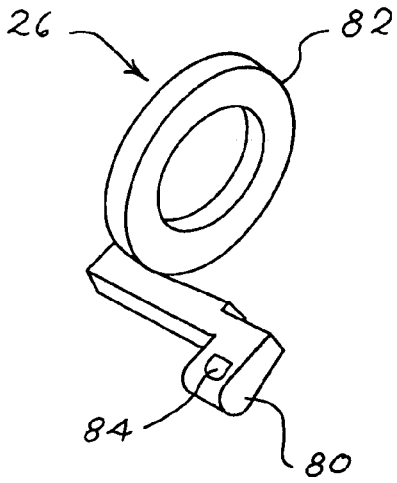
Fig. 9
Fig. 10
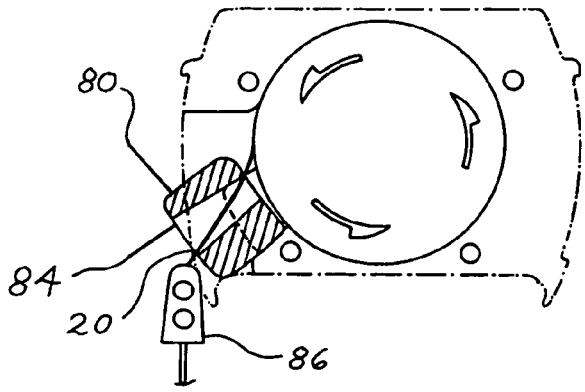

Fig. 11
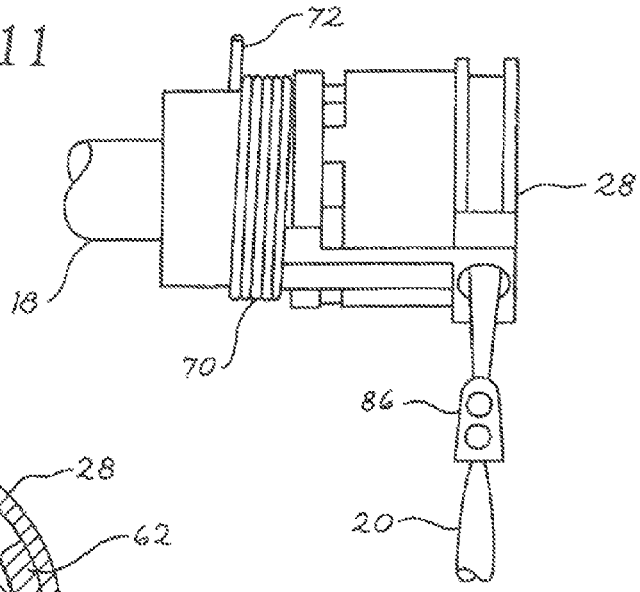
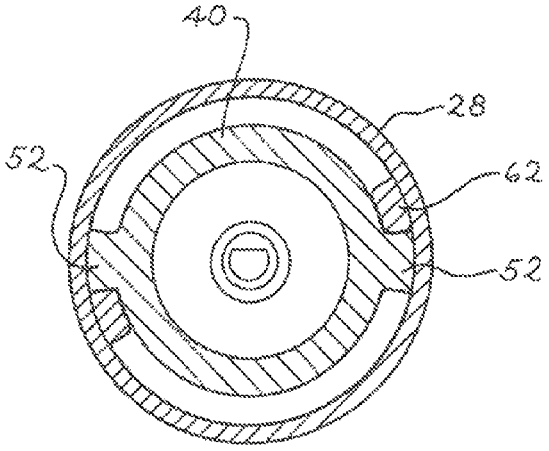
Fig. 12
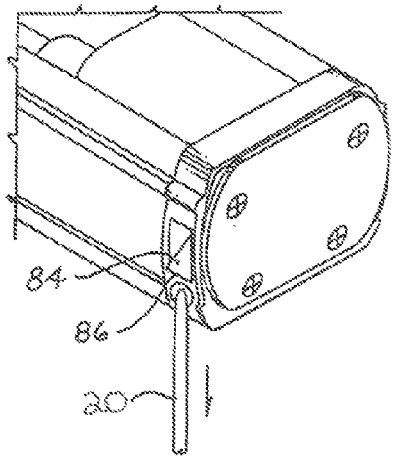
Fig. 13
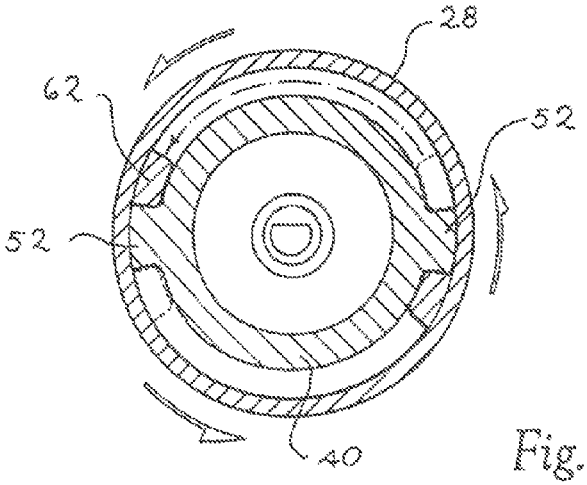
Fig. 14

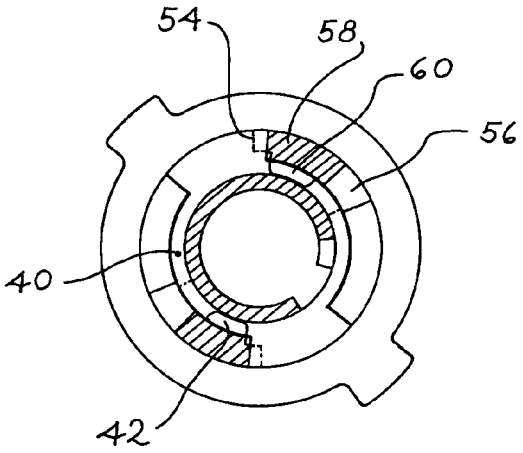
Fig. 15
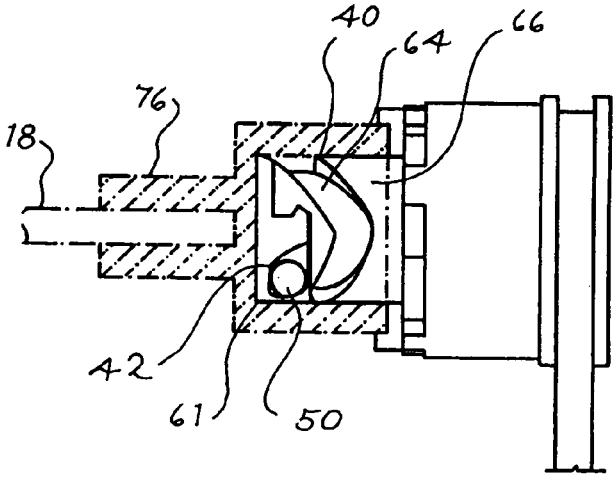
Fig. 16
Fig. 17
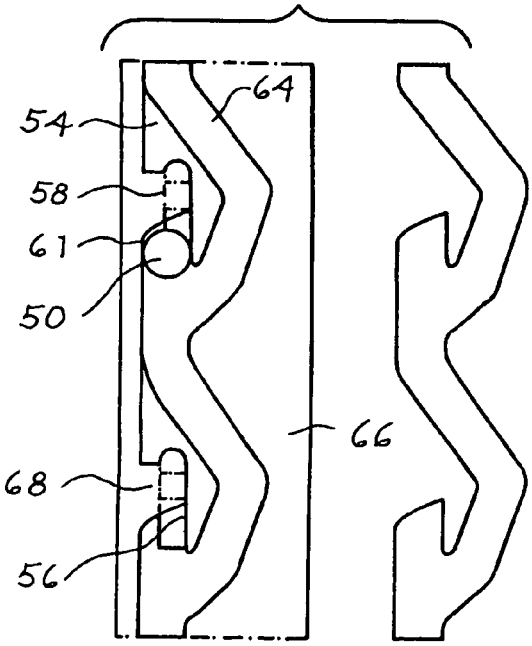

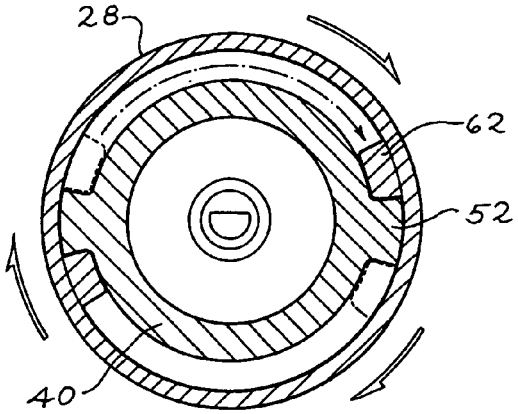
Fig. 18
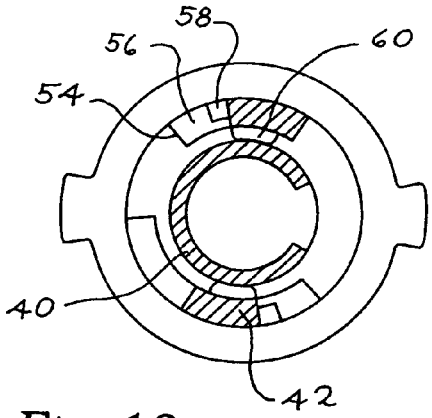
Fig. 19
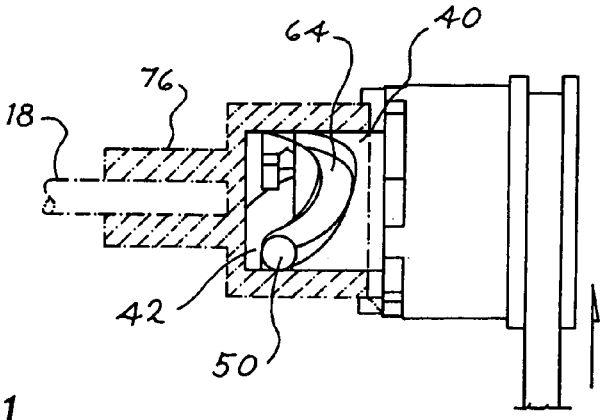
Fig. 20
Fig. 21
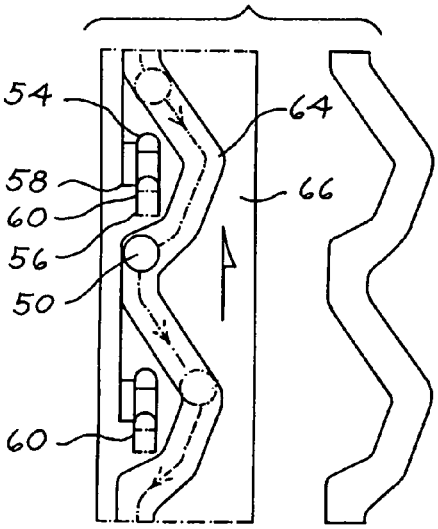

CONTROL MODULE HAVING A CLUTCH FOR RAISING AND LOWERING A WINDOW SHADE

FIELD OF INVENTION

The present invention generally relates to a window shade utilizing a control module adapted for connection to a drive axle of a window shade for raising or lowering of the window shade.

BACKGROUND OF INVENTION

There are numerous types of window shades and window coverings. Examples of such include Venetian blinds, Roman shades, and cellular shades. Window shades may be lowered to cover windows and minimize sunlight exposure to a room or area while increasing privacy and preventing others from viewing through the window. Window shades may be raised to provide a full and clear view through the window or permit sunlight to pass. Typically, a window shade may be raised or lowered by manipulating an operating cord. The user may pull the operating cord in a downward direction to raise the window shade and release the operating cord to lower the window shade.

In typical fashion, the operating cord is attached to a drive axle within the window shade assembly and used to raise or lower the window shade. Pulling the operating cord in a downward direction causes the drive axle to rotate and wind support cords to raise the window shade while releasing the operating cord causes the drive axle to rotate in an opposite direction therefore lowering the window shade. Because of the amount of window shade to be raised, the range of movement of the operating cord can be quite long, and the length of the cord itself when the window shade is raised is also long.

In addition to the generally undesired aesthetic appearance of long operating cords, operating cords may cause a significant threat to various users and in particular to young children. There is a possibility that young children may asphyxiate if an operating cord becomes tangled around their neck. For this reason, it is important to maintain an operating cord at a high location outside the reach of young children. This may be difficult to do when dealing with certain types of windows and window shades. Generally, while window shades are at a closed position, the operating cord is at a high location. When the user pulls down on the operating cord to open the window shade, the operating cord may move to a lower position where it may dangle at a dangerously low position. This low location creates a danger for young children.

Oftentimes, it may be difficult for users to manipulate long operating cords of this nature. A user may use arm movements to pull the operating cord downward. At a certain point, however, the user's arm is fully extended and the user can no longer pull the cord downward. This requires that the user must release and re-grip the operating cord at a higher location and continue pulling the operating cord downward to take the window shade to a desired height. This procedure may be tedious and unduly cumbersome.

SUMMARY OF THE INVENTION

The present invention relates to a novel control mechanism for raising and lowering a window shade that allows for operation of the window shade with a shorter length of operating cord. The control mechanism is biased toward a locked position for maintaining a desired state of opening of the window shade. The control mechanism is switchable to an unlocked position by pulling action on an operating cord or control stick, and enables one to lower the bottom rail of the window shade.

A window shade assembly may have a window shade that may be raised or lowered by pulling on an operating cord. A user may lower the window shade by gently pulling the operating cord in a downward direction. The user may raise the window shade by continuously pulling the operating cord in a downward direction.

The window shade may be raised by a process of pulling and releasing the operating cord. This process may be similar to a ratcheting technique. The user may pull the operating cord to raise the window shade, then allow the operating cord to retract, and then pull the operating cord again to continue to raise the window shade. This process may be repeated until the window shade reaches a proper height. This configuration allows the window shade to be configured with an operating cord having a much shorter length than other window shade assemblies known in the art. The operating cord can be less than half the length of the window shade and is generally preferred to be about one third the height of the window shade meaning three pulls on the operating cord will fully raise the shade.

The window shade assembly of the present invention has a clutch, which enables a user to pull the operating cord in a downward direction and raise the window covering and then release the operating cord allowing it to retract in an upward direction. When the clutch is disengaged from the drive axle, the retraction of the operating cord will not cause the window shade to be moved. Instead, the window shade will remain in a fixed position. The user may then again continuously pull the operating cord in a downward direction to continue to raise the window shade. This process may be repeated until the window shade reaches a desired height.

While the operating cord is continuously pulled in a downward direction, a brake mechanism is moved to an unlocked position allowing rotation of the drive axle and the clutch operatively engages a cord drum assembly with the drive axle.

The operating cord is pulled and the brake mechanism is moved to an unlocked position by a brake release that moves from an initial biased locked position to a release position allowing the brake mechanism to unlock and permit rotation of the drive axle. The brake mechanism may move to an unlocked position when the brake release is moved by the downward movement of the operating cord or movement of a separately connected control stick. In one example, the brake mechanism may include a spring element, such as a torsion spring, configured to tightly clamp the adapter sleeve in its initial locked position so as to preclude the adapter sleeve from rotating thereby maintaining the drive axle in a fixed position and the window shade locked at a particular height. Once the operating cord is pulled, the brake release moves a portion of the spring element thereby loosening the grasp of the spring element around the adapter sleeve and allowing the operating sleeve to rotate.

The operating cord is pulled and the clutch engages the cord drum assembly with the drive axle. The drive axle is operatively connected to the window shade by way of a raised cord and may raise or lower the window shade by rotating in a particular direction. When the clutch is engaged, the operating cord may be used to rotate the cord drum to connect and rotate the drive axle to raise the window shade. When the clutch is disengaged, the cord drum is not connected to the drive axle and rotates independent of the drive axle. In one example, the clutch may be used to connect the cord drum assembly with an adapter sleeve secured to the drive axle. When the clutch is engaged, the cord drum assembly, the adapter sleeve, and the drive axle are configured to rotate together to raise the window shade.

In one example, the clutch may include a first coupling element and a second coupling element. The first coupling element and second coupling element may be configured to rotate together to a first position and a second position. At the first position, the outer surfaces of the first and second coupling elements may define a guide track that forms a closed-loop configuration. At the second position, the outer surfaces of the first and second coupling elements may include a guide track that forms a loop configuration having a stop region. A track member, such as a rolling ball, may be configured to move in the guide track as the first and second coupling elements rotate. The first and second coupling elements may rotate together while the rolling ball is lodged at the stop region. During this rotation, the rolling ball may contact and engage a radial groove of the adapter sleeve. This configuration allows the clutch to engage and connect the cord drum to the adapter sleeve. The first and second coupling elements and the adapter sleeve may therefore rotate together to drive the drive axle and raise the window shade.

In another example, the clutch may include a coupling element having at least one stud and a plurality of cogs configured to move in an axial direction along the drive axis. The at least one stud may be configured to engage at least one guide track located at an outer surface of the cord drum. As the cord drum rotates in a first direction, the guide track moves around the at least one stud allowing the coupling element to move in an axial direction toward the adapter sleeve. During the rotation, the at least one stud will reach an end point of the guide track and the plurality of cogs of the coupling element will engage a plurality of cogs of the adapter sleeve. It will be appreciated that the at least one stud of the coupling element and the at least one guide track may be switchable so as to allow at least one stud on the cord drum to engage at least one guide track on the cord drum. These configurations allow the clutch to engage and connect the cord drum to the adapter sleeve. The cord drum, coupling element, and the adapter sleeve may therefore rotate together to drive the drive axle and raise the window shade.

BRIEF DESCRIPTION OF THE DRAWINGS

FIG. 3 is a side view of the control module in accordance with a preferred embodiment of the invention;

FIG. 4 is a perspective view of a first coupling element of a clutch in accordance with a preferred embodiment of the invention;

FIG. 5 is a perspective view of a second coupling element of the clutch in accordance with a preferred embodiment of the invention;

FIG. 6 is side view of a brake mechanism of the control module in accordance with a preferred embodiment of the invention;

FIG. 7 is a perspective view of an adapter sleeve of the control module in accordance with a preferred embodiment of the invention;

FIG. 8 is front-elevation view of the adapter sleeve of the control module in accordance with a preferred embodiment of the invention;

FIG. 9 is a perspective view of a brake release of the control module in accordance with a preferred embodiment of the invention;

FIG. 10 is a side view of the brake release of the control module in a release position in accordance with a preferred embodiment of the invention;

FIG. 11 is a side view of a cord drum assembly of the control module in accordance with a preferred embodiment of the invention;

FIG. 12 is a front-elevation view of a cord drum assembly and first coupling element of the clutch in accordance with a preferred embodiment of the invention;

FIG. 13 is a perspective view of the brake release having a locked up position and a release down position in accordance with a preferred embodiment of the invention;

FIG. 14 is a front-elevation view the cord drum assembly rotating in a first forward direction with the first coupling element of the clutch in accordance with a preferred embodiment of the invention;

FIG. 15 is front-elevation view of the first coupling element of the clutch having a plurality of radial ribs and the second coupling element of the clutch having a plurality of radial ribs rotating to one another in accordance with a preferred embodiment of the invention;

FIG. 16 is a side view of the first coupling element of the clutch having a guide track and the second coupling element of the clutch rotating together to form a loop configuration having a stop region in accordance with a preferred embodiment of the invention;

FIG. 17 is an unfolded side view of an outer surface of the first coupling element having a guide track and second coupling element rotating together to form a loop configuration having a stop region in accordance with a preferred embodiment of the invention;

FIG. 18 is a front-elevation view of the cord drum assembly rotating in a second direction reverse direction with the first coupling element of the clutch in accordance with a preferred embodiment of the invention;

FIG. 19 is a front-elevation view the first coupling element of the clutch having a plurality of radial ribs and the second coupling element of the clutch having a plurality of radial ribs rotating together in accordance with a preferred embodiment of the invention;

FIG. 20 is a side view the first coupling element having a guide track and the second coupling element rotating together to form a closed-loop configuration in accordance with a preferred embodiment of the invention;

FIG. 21 is an unfolded side view of the outer surface of the first coupling element having a guide track and the second coupling element where a closed-loop configuration is formed in accordance with a preferred embodiment of the invention;

DETAILED DESCRIPTION OF PREFERRED EMBODIMENTS OF INVENTION

Figure 1:
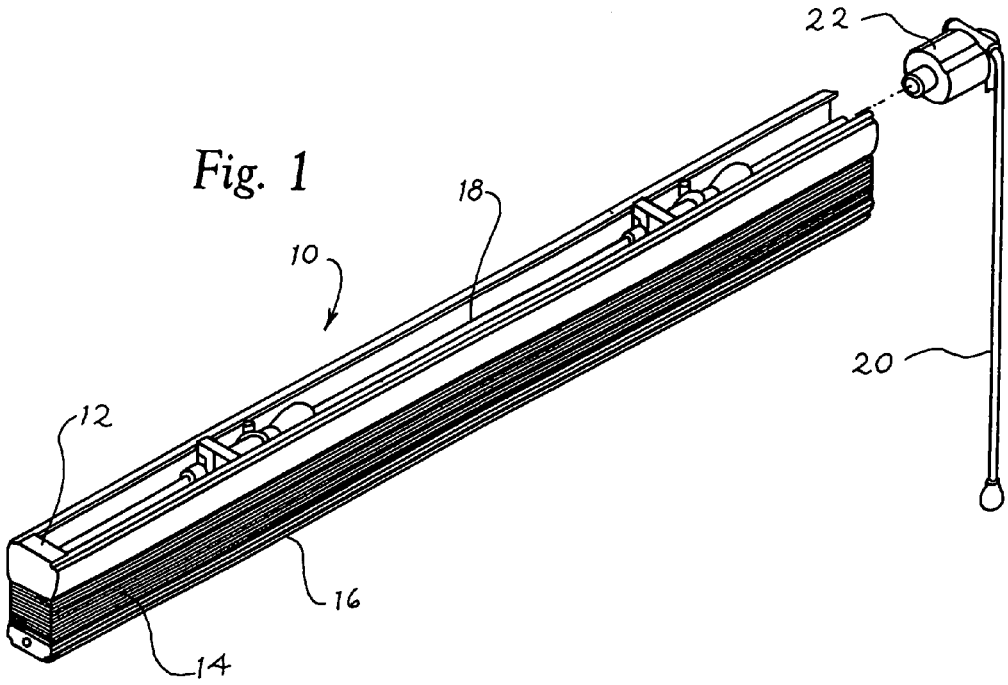
FIG. 1 is a perspective view of a window shade assembly having a control module in accordance with a preferred embodiment of the invention.

The invention disclosed herein is susceptible to embodiment in many different forms. The embodiments shown in the drawings and described in detail below are only for illustrative purposes. The disclosure is intended as an exemplification of the principles and features of the invention, but does not limit the invention to the illustrated embodiments.

Referring to FIG. 1, a window shade assembly 10 is shown. The window shade assembly 10 may include a head rail 12, a window shade 14, a bottom rail 16, a drive axle 18, an operating cord 20, a control module 22, and suspension cords (not shown) connecting between the head rail 12 and the bottom rail 16. The window shade 14 may be opened by raising the bottom rail 16 toward the head rail 12. Raising the bottom rail 16 may be effected by manipulating the operating cord 20, so as to wind the suspension cords connecting between the head rail 12 and the bottom rail 16. Lowering of the bottom rail 16 and closing of the window shade 14 may be done by manipulation of the operating cord 20 to unwind the suspension cords, and thereby lower the bottom rail 16. Using suspension cords to raise the bottom rail to raise or lower the window shade is described in U.S. Pat. No. 7,275,580 to Yu and U.S. Patent Publication No. 2008/00179017 to Yu et al. which are hereby incorporated by reference.

The window shade 14 may be of any type generally known in the art. In one example, the window shade 14 may be a cloth material such as a honeycomb material, Venetian blinds, or any other type of shade known in the art. In another example, the window shade 14 may include a plurality of rails or slats extending vertically and parallel to one another.

The head rail 12 may be of any types and shapes generally known in the art. The head rail 12 may be located at a top portion of the window shade assembly 10 and configured to mount the drive axle 18 and control module 22. The bottom rail 16 may be of any type generally known in the art and located at a bottom portion of the window shade assembly 10.

The bottom rail 16 may be raised by the operating cord 20 and the suspension cords (not shown) to move the window shade 14 in an upward direction.

The drive axle 18 may define a drive axis and be operatively connected to the bottom rail 16 such that rotation of the drive axle 18 will cause the bottom rail 16 to raise or lower. In one example, the rotation of the drive axle 18 causes the suspension cords to raise the bottom rail 16 and therefore raise the window shade 14. The drive axle 18 may be operatively connected with the control module 22 and configured to raise or lower the window shade 14 in response to movement of the operating cord 20.

Referring to FIGS. 1-25, the window shade assembly 10 may permit a user to raise and lower the window shade 14 by pulling on the operating cord 20. The user may lower the window shade 14 by gently pulling the operating cord 20 in a downward direction. The user may then release the operating cord 20, which will shift in an upward direction. The upward shift of the operating cord 20, however, will not cause the window shade 14 to be raised or lowered. Instead, the window shade 14 will remain at a fixed and locked height. The user may continuously pull the operating cord 20 in a downward direction to continue to raise the window shade 14.

In one example, a window shade assembly 10 may have a relatively shorter operating cord 20 that allows the user to raise the window shade by repeatedly pulling the operating cord 20 and then releasing the operating cord 20. The operating cord 20 can be less than one half the height of the window shade. When the operating cord is one third the height of the window shade, the window shade is raised in three pulls of the cord. This process is similar to a ratcheting technique allowing the user to pull the operating cord 20 to raise the window shade 14 a certain amount, then allow the operating cord 20 to retract, and then pull the operating cord 20 again to continue to raise the window shade. This process may be repeated until the window shade 14 reaches a desired height. This configuration allows the operating cord to be a much shorter length than those traditionally used in the art.

Figure 2:
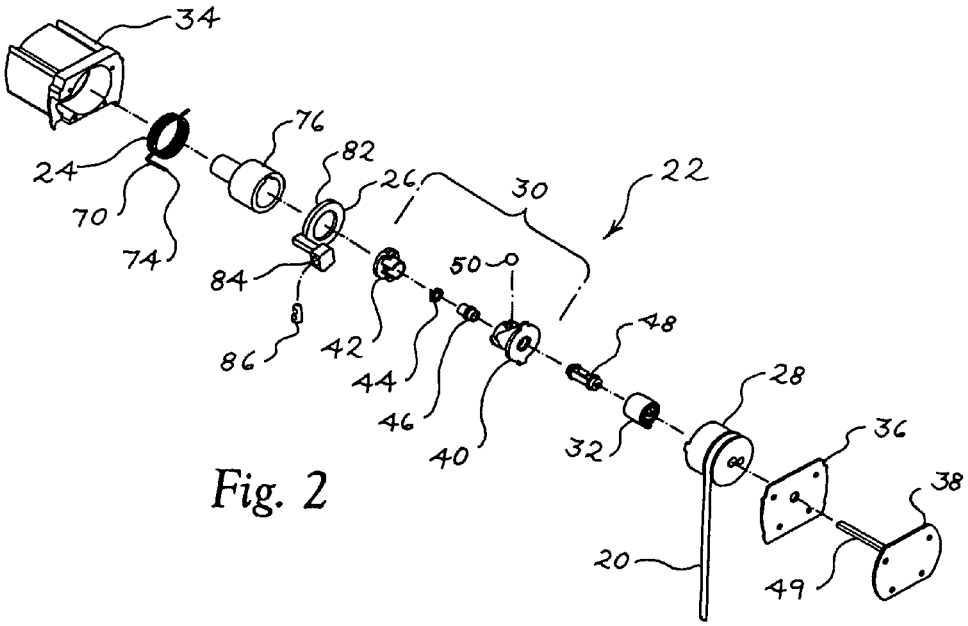
FIG. 2 is an exploded view of the control module of the window shade assembly in accordance with a preferred embodiment of the invention.

One example of a control module 22 that enables the described operation is shown in FIGS. 2 and 3. The control module 22 includes a brake mechanism 24, a brake release 26, a cord drum 28, and a clutch 30. The control module 22 preferably also includes a motor mechanism 32 such as a spring motor for driving the cord drum 28. The motor mechanism 32, however, may also be disposed at a location external of the control module 22. The control module 22 may also include a housing 34, a support panel 36, and a lid panel 38 configured to enclose the different elements of the control module 22.

The clutch 30 is adapted to selectively couple and uncouple movements of the cord drum 28 with the drive axle 18. When the clutch 30 is in an uncoupled state, relative movements between the drive axle 18 and the cord drum 28 are permitted, e.g., the drive axle 18 driven by the weight of the bottom rail 16 and window shade 14 can rotate independent from the cord drum 28 kept stationary for lowering the window shade 14 and bottom rail 16, or the cord drum 14 can rotate to wind the operating cord 10 while the drive axle 18 is locked in a stationary position. When the clutch 30 is in a coupled state, rotation of the cord drum 28 can be transmitted to the drive axle 18 via the clutch 30 for raising the window shade 14 and bottom rail 16.

In this embodiment, the clutch 30 may be located between the brake mechanism 24 and the cord drum 28, and may include a first coupling element 40, a second coupling element 42, a spring element 44, mounting fixtures 46 and 48, and a rolling member 50 such as a rolling ball. In some examples, the clutch 30 may also include an adapter sleeve 76.

Referring to FIGS. 3-5, the mounting fixtures 46 and 48 can be affixed at spaced-apart positions on a stationary rod 49 extending from the lid panel 38 along the axis of the drive axle 18. The first coupling element 40 may be pivotally assembled around at least one portion of the mounting fixture 48, and the second coupling element 42 may be pivotally assembled around at least one portion of the other mounting fixture 46, such that the first coupling element 40 and second coupling element 42 can rotate around the axis of the drive axle 18 in either directions for turning the clutch 30 to either of the coupled state and uncoupled state.

Referring to FIG. 4, the first coupling element 40 may be generally cylindrical and configured to mate with the second coupling element 42. More specifically, the first coupling element 40 preferably comprises a cylindrical outer surface 66 that extends between two end portions of the first coupling element 40. The outer surface 66 includes a recessed region that extends around the first coupling element 40 so as to define at least partially a guide track 64 of the clutch 30, and at least one notch 65. In one example, two notches 65 can be provided approximately diametrically opposite from each other. A first end portion of the first coupling element 40 proximate to the cord drum 28 includes two opposite radial flanges 52 with which the cord drum 28 can engage for driving rotational movements of the first coupling element 40 in either direction. A second end portion of the first coupling element 40 proximate to the second coupling element 42 has at least one radial abutment 54 disposed at a position proximate to the notch 65 (FIG. 14). Two radial abutments 54 are preferably formed on an outer surface of the first coupling element 40 at approximately diametrically opposite positions, and proximate to each corresponding notch 65. The first coupling element 40 also includes at least one groove 56 that is angularly spaced apart from the radial abutment 54. Preferably two grooves 56 are formed on an outer surface of the first coupling element 40 at approximately diametrically opposite positions, each groove 56 being in proximity of one corresponding radial abutment 54.

Referring to FIG. 5, the second coupling element 42 may be generally cylindrical and configured to mate with the first coupling element 40. The second coupling element 42 preferably has two approximately diametrically opposite radial ribs 58 each having an outer surface 68, and an extension 60 that extends from each radial rib 58 along a radial direction towards the center of the second coupling element 42.

As shown in FIG. 21, when the first and second coupling elements 40 and 42 are assembled with each other, a closed-loop guide track 64 that runs along the circumference of the first and second coupling elements 40 and 42 is formed between the outer surfaces 66 and 68 of the first and second coupling elements 40 and 42. Each of the radial ribs 58 can then be movably received at least partially in one corresponding notch 65 of the first coupling element 40, and the extension 60 can be movably inserted through a corresponding groove 56 for guiding the relative movement between the first and second coupling elements 40 and 42. The radial ribs 58 can thereby slide in the notches 65 to form or remove stop regions 61 (as better shown in FIG. 17) in the guide track 64.

Referring to FIGS. 6-8, the adapter sleeve 76 is preferably generally cylindrical and is affixed on the drive axle 18 such that both the adapter sleeve 76 and the drive axle 18 rotate in unison. The adapter sleeve 76 includes a central hole 77, and a radial groove 78 formed on an inner surface of the central hole 77 and extending linearly parallel with the axis of the drive axle 18. Once the clutch 30 is assembled, the first and second coupling elements 40 and 42 are positioned through the central hole 77 of the adapter sleeve 76, such that the guide track 64 at least partially overlaps with the length of the radial groove 78 in the adapter sleeve 76, the rolling member 50 being movably engaged into the guide track 64 and radial groove 78.

When the clutch 30 is in the uncoupled state, the relative position between the first and second coupling elements 40 and 42 is such that the rolling member 50 can move along the radial groove 78 and the guide track 64 around the circumference of the first and second coupling elements 40 and 42 as the drive axle 18 and adapter sleeve 76 rotate, independent from the cord drum 28. When the clutch 30 is in the coupled state, the second coupling element 42 is angularly shifted to a second position relative to the first coupling element 40 so as to form a recessed stop region 61 in the guide track 64 at a position shifted radially from the notch 65 (as shown in FIG. 17). As a result, movement of the rolling member 50 along the guide track 64 and radial groove 78 can be blocked at the stop region 61, such that rotational movement from the cord drum 28 can be transmitted through the first and second coupling elements 40 and 42 to the adapter sleeve 76 and drive axle 18. Still, in another example, the clutch 30 may be adapted to transmit rotational movement from the cord drum 28 directly to the drive axle 18.

Referring to FIGS. 11 and 12, the cord drum 28 can be generally cylindrical and pivotally assembled around the stationary rod 49, at a position adjacent to one side of the first coupling element 40 that is opposite the side of the second coupling element 42. The cord drum 28 is connected with the operating cord 20, and is operable to rotate for winding the operating cord 20 around the cord drum 28. The cord drum 28 also includes at least one radial flange 62 at one end portion proximate to the first coupling element 40 that can engage with the radial flange 52 of the first coupling element 40 for driving rotating movements of the clutch 30.

Referring to FIGS. 2, 11 and 12, the cord drum 28 is coupled with the motor mechanism 32, which is configured to drive rotation of the cord drum 28 in a direction to wind the operating cord 20 thereon. The motor mechanism 32 can be a torsion spring that is assembled through an inner cavity of the cord drum 28, the torsion spring having a first end affixed on the stationary rod 49 and a second end affixed with the cord drum 28. Alternatively, the motor mechanism 32 may be located externally of the control module 22 and used to drive the reverse rotation of the cord drum 28. In this example, the motor mechanism 32 may be a motor device separate from the control module 22 but still operatively connected to the cord drum 22 to drive the reverse rotation of the cord drum 22.

Referring to FIGS. 2, 3, 6, 9 and 10, the brake mechanism 24 is mounted around the drive axle 18, and is operable to either tighten and lock the drive axle 18 in position, or loosen and unlock the drive axle 18 for allowing its rotation in either direction. In the illustrated embodiment, the brake mechanism 24 can include a spring element 70, such as a torsion spring. The spring element 70 has a generally cylindrical shape, and is mounted around the adapter sleeve 76. The spring element 70 has a first prong 72 and a second prong 74. The first prong 72 extends outward from the spring element 70 and is anchored with the housing 34, whereas the second prong 74 extends outward from the spring element 70 and is anchored with the brake release 26 operable by a user.

Referring to FIGS. 9 and 10, the brake release 26 can be operable to lock and unlock the brake mechanism 24. In one embodiment, the brake release 26 can include a generally cylindrical collar portion 82, and a release actuator crank 80 connected with the collar portion 82 at an eccentric position and securely joined with the second prong 74 of the spring element 70. The collar portion 82 can be mounted coaxial to the drive axis of the drive axle 18, but is independent from the movement of the drive axle 18. In the illustrated embodiment, the collar portion 82 is pivotally assembled around a portion of the first coupling element 40, with the release actuator crank 80 extending generally parallel to the drive axis of the drive axle 18. When the brake release 26 is in the locked position, the release actuator crank 80 is located at a relatively higher position and the spring element 70 of the brake mechanism 24 can tighten and lock the drive axle 18 in position. When the brake release 26 is pulled downward to a release position, the release actuator crank 80 is shifted to a relatively lower position, which also pulls the second prong 74 in a direction to loosen the spring element 70 and unlock the drive axle 18, thereby allowing the drive axle 18 to rotate.

A bore 84 may also be provided at an end portion of the release actuator crank 80 and configured to receive a release mechanism for actuating the brake release 26. At least a portion of the operating cord 20 may movably pass through the bore 84 and a stop plug 86 fixedly attached on the operating cord 20 may engage with the bore 84. While the stop plug 86 is engaged with the bore 84, a user may gently pull the operating cord 20 to move the brake release 26 to the release position to unlock the drive axle 18 and allow its rotation.

While the operating cord 20 is not being manipulated by the user, the window shade 14 is locked in a fixed position. In this position, the spring element 70 of the brake mechanism 24 tightens on the adapter sleeve 76, which blocks rotation of the drive axle 18. Alternatively, the adapter sleeve 76 may be removed and the spring element 70 may tighten directly around the drive axle 18 to block the rotation.

As shown in FIG. 13, when the user wants to lower the bottom rail 16, the operating cord 20 can be gently pulled downward to move the brake release 26 to the release position and cause the spring element 70 to loosen. The brake release 26 may be moved to the release position by biasing the release actuator crank 80 to a down position. In the illustrated example, the release actuator crank 80 can be moved to the down position by slightly pulling the operating cord 20 downward, the movement of which is transmitted to the release actuator crank 80 via engagement between the stop plug 86 and the bore 84. In other embodiments, the release actuator crank 80 can also be moved to the down position by pulling downward a control stick 87 that is separate from the operating cord 20 and connected with the release actuator crank 80. With the stop plug 86 remaining engaged with the bore 84 and the brake release 26 kept in the release position, the unlocked drive axle 18 can rotate in a direction that unwinds the suspension cords attached with the bottom rail 16, driven by the weight of the bottom rail 16 and window shade 14 stacked thereon. While the drive axle 18 and adapter sleeve 76 rotate for lowering the bottom rail 16, the rolling member 50 rolls along the radial groove 78 and the guide track 64 of the clutch 30. More specifically, while the bottom rail 16 is lowered, the spring element 44 can exert resistance to keep the first and second coupling elements 40 and 42 stationary, such that the clutch 30 can remain in the uncoupled state without stop regions 61 in the guide track 64. In this uncoupled state, the radial rib 58 of the second coupling element 42 is spaced apart from the radial abutment 54 in the notch 65 of the first coupling element 40.

Once the bottom rail 16 moving downward reaches the desired height, the brake release 26 can be moved to the locked position as the spring element 70 recovers its initial state and tightens around the adapter sleeve 76, thereby locking the drive axle 18 and adapter sleeve 76 in position and allowing the bottom rail 16 to be locked at the desired height.

Referring to FIGS. 14-17, when the user wants to raise the bottom rail 16, the operating cord 20 can be pulled downward, causing the brake release 26 to move to the release position and unlock the drive axle 18 and adapter sleeve 76. Once the brake release 26 is in the release position, further downward pulling of the operating cord 20 forces the stop plug 86 to dislodge from the bore 84, and causes the operating cord 20 to unwind from the cord drum 28 and slide through the bore 84. As shown in FIG. 14, the cord drum 28 rotates in a direction that unwinds the operating cord 20, causing the radial flange 62 of the cord drum 28 to push against the radial flange 52 of the first coupling element 40. The first coupling element 40 is thereby angularly urged to move relative to the second coupling element 42, until the radial abutment 54 of the first coupling element 40 comes in contact and pushes against the radial rib 58 of the second coupling element 42, as shown in FIG. 15. In this second position, the configuration of the guide track 64 is changed to form the stop region 61 therein, as shown in FIGS. 16 and 17.

As the operating cord 20 is further pulled downward, the cord drum 28 and clutch 30 rotate in unison until the rolling member 50 is positioned in the stop region 61. In the illustrated embodiment, two stop regions 61 can be formed in the guide track 64 so as to limit the course of the rolling member 50 for reaching the closest stop region 61. Once the rolling member 50 reaches the stop region 61, the clutch 30 is turned to the coupled state. Owing to the abutment of the rolling ball 50 at the stop region 61 and in the radial groove 78 of the adapter sleeve 76, further pulling action on the operating cord 20 in the same direction can cause rotation of the cord drum 28, which can be transmitted from the cord drum 28 to the clutch 30 via contact between the radial flanges 62 and 52, and from the clutch 30 to the drive axle 18 via engagement of the rolling member 50 between the radial groove 78 of the adapter sleeve 76 and the stop region 61 of the clutch 30. The bottom rail 16 can then be raised by rotation of the cord drum 28 driven by pulling down the operating cord 20.

The user may release the operating cord 20 at any particular time such as when the bottom rail 16 has reached a desired height or after the operating cord 20 has been fully extended. In response, the spring element 70 returns to its tightened configuration and tightly holds around the adapter sleeve 76, while the release actuator crank 80 of the brake release 26 biased by the spring element 70 moves upward to its initial locked position. The tightened configuration of the spring element 70 securely locks and blocks rotation of the adapter sleeve 76 and drive axle 18. As a result, both the adapter sleeve 76 and drive axle 18 are fixed and the window shade 14 is locked in position at the desired height. Meanwhile, the motor spring 32 drives reverse rotation of the cord drum 28 thereby causing the operating cord 20 to retract and wind about the cord drum 28.

Referring to FIG. 18, as the cord drum 28 rotates in the reverse direction, the radial flange 62 of the cord drum 28 contacts and pushes against the diametrically opposite radial flange 52 of the first coupling element 40 for driving the first coupling element 40 to rotate in unison relative to the second coupling element 42.

Referring to FIGS. 19-21, the rotation of the first coupling element 40 and the cord drum 28 causes the radial abutment 54 of the first coupling element 40 to move away from the radial rib 58 of the second coupling element 42, until another abutment position is reached for recovering the configuration of the closed-loop guide track 64 without stop regions 61 shown in FIG. 21. The configuration of the closed-loop guide track 64 without stop regions 61 may be reached when the extension 60 abuts against an end edge 56A of the groove 56 as shown in FIG. 4. This causes the clutch 30 to move to the uncoupled state while the motor mechanism 32 further drives reverse rotation of the cord drum 28 for winding the operating cord 20 as the first and second coupling element 40 and 42 rotate in unison. Since the stop regions 61 are removed from the guide track 64, this coupled rotation of the first and second coupling elements 40 and 42 results in a course of the rolling member 50 along the guide track 64 and the groove 78 in the adapter sleeve 76. Locked by the spring element 70, the adapter sleeve 76 and drive axle 18 are kept stationary as the first and second coupling elements 40 and 42 and cord drum 28 rotate for winding the operating cord 20. The bottom rail 16 and window shade 14 can be locked in position as the operating cord 20 is wound around the cord drum 28. Once the winding is partially or entirely complete (the operating cord 20 can be wound around the cord drum 28 until the stop plug 86 engages with the bore 84), the user may again pull the operating cord 20 in a downward direction to further lift the window shade 14. This process may be repeated until the window shade 14 reaches the desired height.

In an alternate embodiment, as shown in FIGS. 22-25D, a control stick 87 may be additionally connected to the release actuator crank 80 and operable to move the brake release 26 from the initial locked position to the release position. As shown in FIGS. 23A-23D, the control stick 87 may have a generally hollow cavity such that the operating cord 20 passes through the hollow interior and extends a distance beyond a distal end 89 of the control stick 87. Referring to FIGS. 23A-23C, when the user wants to lower the bottom rail 16, the control stick 87 can be pulled downward to move the brake release 26 to the release position. While the control stick 87 is pulled downward, the distance between the distal edge 89 of the control stick 87 and the end of the operating cord 20 may slightly decrease. Since the control stick 87 is connected to the release actuator crank similar to 80 on FIGS. 9 and 10, the operating cord 20 is specifically used for raising the bottom rail 16 and may not necessarily need the stop plug similar to 86 in FIGS. 10 and 11. As shown in FIG. 23D, when pulled, the operating cord 20 slides downward to extend further outside the control stick 87, and causes the brake release 26 to move to the release position by applying a downward force on the release actuator crank. As the operating cord 20 unwinds, the cord drum 28 is driven in rotation to cause the bottom rail 16 to raise in the same manner described previously. While the operating cord 20 is being pulled, the distance between the distal edge 89 of the control stick 87 and the end of the operating cord 20 increases.

Figure 25A:
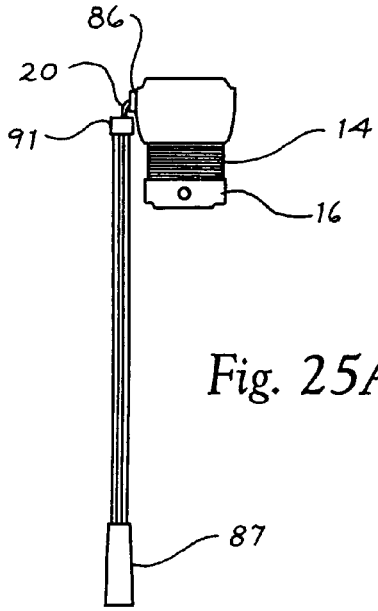
FIG. 25A is side view of the window shade assembly of FIG. 24 where the bottom rail of the window shade assembly is at a raised position.
Figure 25B:
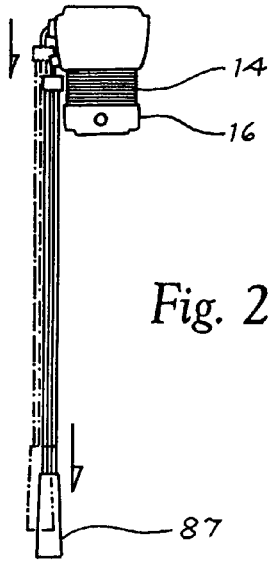
FIG. 25B is a side view of the window shade assembly of FIG. 24 showing the control stick operably moving the brake release from the locked up position to the release down position.
Figure 25C:
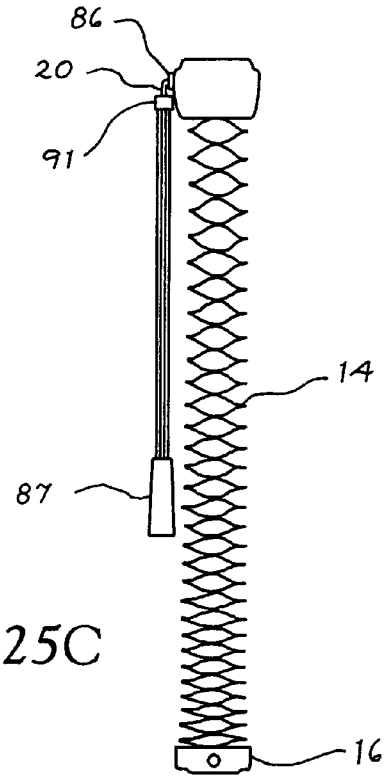
FIG. 25C is a side view of the window shade assembly of FIG. 24 where the bottom rail of the window shade assembly is at a lowered position.
Figure 25D:
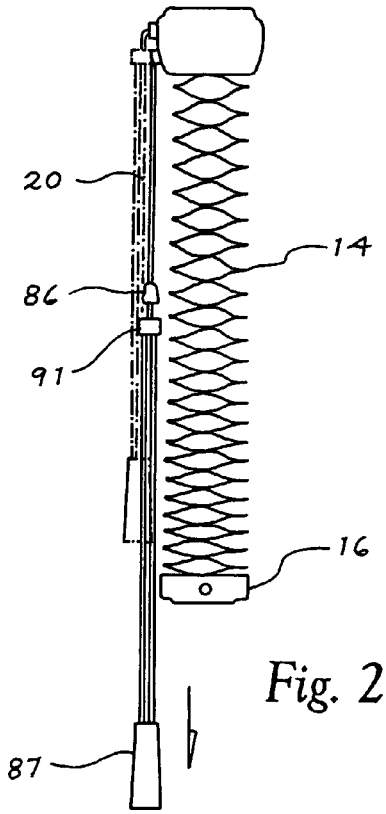
FIG. 25D is a side view of the window shade assembly of FIG. 24 showing the control stick pulling the operating cord for raising the bottom rail.
Figure 26:
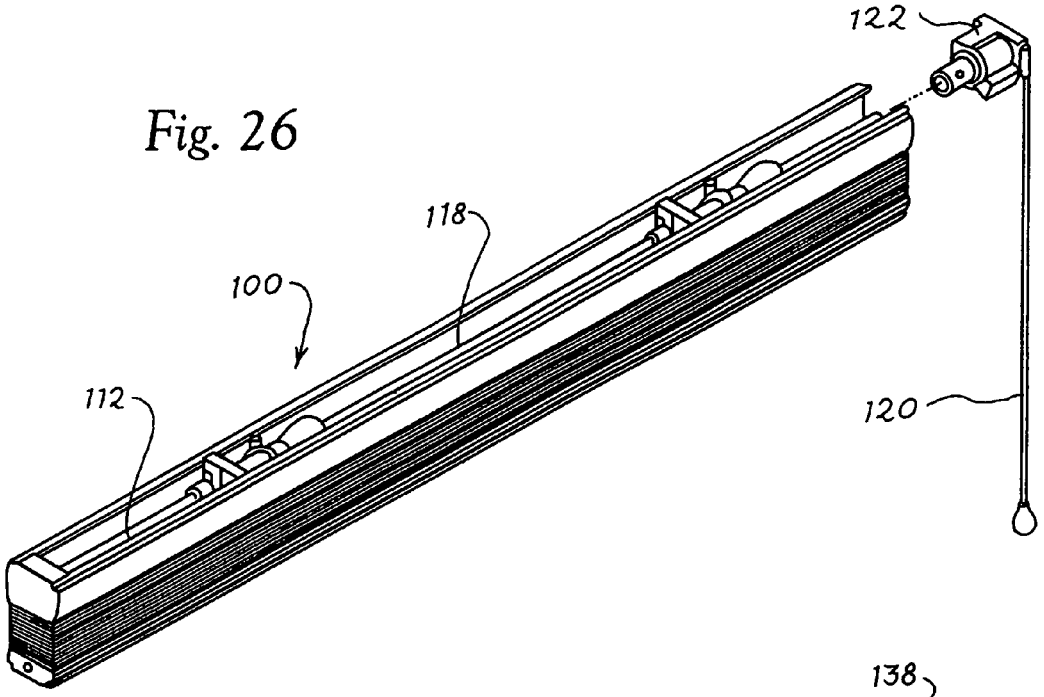
FIG. 26 is a perspective view of a window shade assembly having a control module in accordance with another preferred embodiment of the invention.

In another alternate embodiment, as shown in FIGS. 24 and 25A-25D, the control stick 87 is connected at a lower end 91 of the operating cord 20 proximate to the stop plug 86. As shown in FIGS. 25A-25C, while the stop plug 86 is engaged with the bore 84, the user can lower the bottom rail 16 by gently pulling down on the control stick 87 to move the brake release 26 to the release position. The user can raise the bottom rail 16 by continuously pulling down the control stick 87. As shown in FIG. 25D, the control stick 87 pulls the operating cord 20 causing the stop plug 86 to dislodge from the bore 84 and the cord drum 20 to rotate for raising the bottom rail 16. Although similar to the previous embodiment above having only the operating cord 20, the control stick 87 in this embodiment is generally rigid making it easier for some users to grasp and therefore easier to lower and raise the bottom rail 16.

Another preferred embodiment is shown in FIGS. 26-38. Similar to the previous embodiment of FIGS. 1-25, the window shade assembly 100 may permit a user to raise and lower the window shade 114 by pulling on the operating cord 120. The user may lower the window shade 114 by gently pulling the operating cord 120 in a downward direction. The user may raise the window shade 114 by continuously pulling the operating cord 120 in a downward direction.

Similar to above, the window shade assembly 100 in this embodiment includes the head rail 112, the window shade 114, the bottom rail 116, the drive axle 118, the operating cord 120, the control module 122, and suspension cords (not shown).

One example of the control module 122 that enables the described operation is discussed below and refers to FIGS. 27 and 28. The control module 122 includes the brake mechanism 124, the brake release 126, the cord drum 128, and the clutch 130. The control module 122 may also include a motor mechanism 132 such as the spring motor for driving the cord drum 128. The motor mechanism 132, however, may also be disposed at a location external of the control module 122. The control module 122 may also include the housing 134, the support panel 136, and the lid panel 138 configured to house the different elements of the control module 122.

The clutch 130 is adapted to selectively couple and uncouple movements of the cord drum 128 with the drive axle 118. When the clutch 118 in an uncoupled state, relative movements between the drive axle 118 and the cord drum 128 are permitted, e.g., the drive axle 118 driven by the weight of the bottom rail 116 and window shade 114 can rotate independent from the cord drum 128 kept stationary for lowering the window shade 114 and bottom rail 116, or the cord drum 128 can rotate to wind the operating cord 120 while the drive axle 118 is locked in a stationary position. When the clutch 130 is in a coupled state, rotation of the cord drum 128 can be transmitted to the drive axle 118 via the clutch 130 for raising the window shade 114 and bottom rail 116.

In this embodiment, the clutch 130 may be located between the brake mechanism 124 and the brake release 126 and configured to selectively connect the cord drum 128 with the drive axle 118. The clutch 130 may include a coupling element 140 and a split ring 171. In some examples, the clutch may also include the adapter sleeve 176.

Figure 29A:
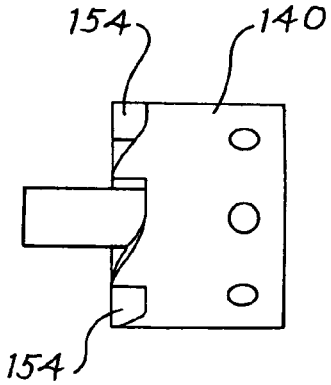
FIG. 29A is a side view a coupling element of a clutch in accordance with another preferred embodiment of the invention.
Figure 29B:
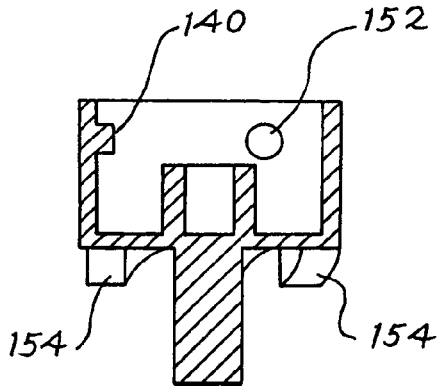
FIG. 29B is a top view of the coupling element of the clutch shown in FIG. 29A in accordance with another preferred embodiment of the invention.
Figure 29C:
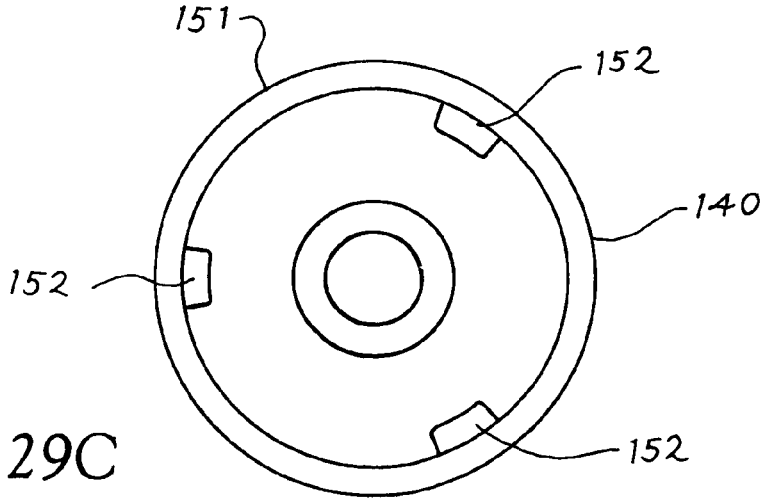
FIG. 29C is a front-elevation view of the coupling element of the clutch shown in FIG. 29A in accordance with another preferred embodiment of the invention.

Referring to FIGS. 29A-29C, the coupling element 140 has a collar portion 151 approximately cylindrical in shape and adapted to mount around a circumference of the cord drum 128, and an opposite end portion facing the adapter sleeve 176. The coupling element 140 is pivotally configured to rotate about the axis of the drive axle 118 and move in an axial direction along the axis of the drive axle 118 for turning the clutch 130 to either the coupled state or uncoupled state.

The coupling element 140 may be generally cylindrical and configured to mate with the adapter sleeve 176 and the cord drum 128. More specifically, the coupling element 140 includes an outer surface that extends between two end portions of the coupling element 140.

Figure 36A:
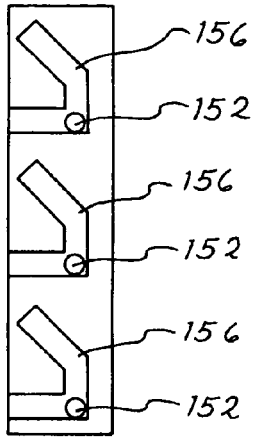
FIG. 36A is an unfolded side view of the cord drum having at least one guide track configured to receive at least one stud portion of the clutch where the at least one stud portion is disposed at a middle portion of the guide track in accordance with another preferred embodiment of the invention.
Figure 37A:
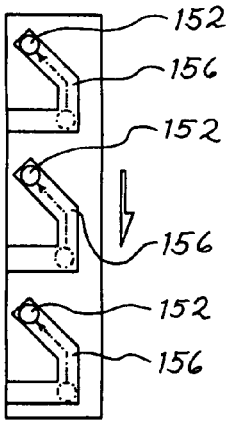
FIG. 37A is an unfolded side view the cord drum having at least one guide track rotating in a first forward direction where the at least one stud moves from the middle portion of the at least one guide track to an end portion of the at least one guide track in accordance with another preferred embodiment of the invention.
Figure 38A:
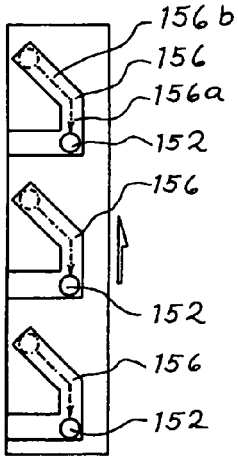
FIG. 38A is an unfolded view of the cord drum having at least one guide track rotating in a second reverse direction where the at least one stud moves from an end portion of the at least one guide track to a middle portion of the at least one guide track in accordance with another preferred embodiment of the invention.
Figure 38B:
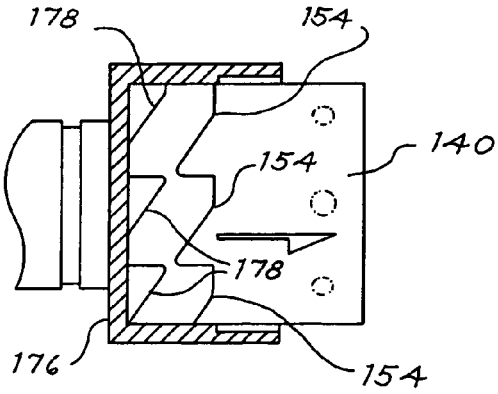
FIG. 38B is a side view of the coupling element of the clutch moving axially away from the adapter sleeve such that the plurality of cogs of the coupling element move to disengage the plurality of cogs of the adapter sleeve in accordance with another preferred embodiment of the invention.

The collar portion 151 of the coupling element 140 has an inner surface that includes at least one radial stud 152 with which the cord drum 128 can engage for driving rotational movements of the coupling element in either direction. The radial stud 52 protrudes inward and inserts into an associated guide track 156 provided on an outer surface of the cord drum 128 that pivotally mounts through the collar portion 151 of the coupling element 140. As shown in FIGS. 36A, 37A and 38A, the radial stud 152 may movably engage the guide track 156 such that the radial stud 152 can move along the guide track 156 as the cord drum 128 rotates. The guide track 156 may be shaped such that rotation of the cord drum 128 can be converted into a translation movement of the coupling element 140 parallel with the drive axle 118 via interaction between the radial stud 152 and guide track 156. For example, as better shown in FIG. 34, the guide track 156 may include a first section 156*a* of an arc-shape centered on the axis of the drive axle 118, and a second section 156*b* that is turned toward the coupling element 140 and connected with an end of the first section 156*a*. The guide track 156 is provided in an amount that corresponds to the amount of radial studs 152 on the coupling element 140.

Figure 36B:
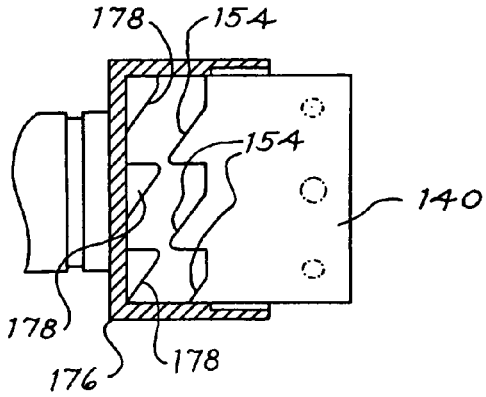
FIG. 36B is a side view the coupling element of the clutch having at least one stud and a plurality of cogs axially spaced from the adapter sleeve having a plurality of cogs in accordance with another preferred embodiment of the invention.
Figure 37B:
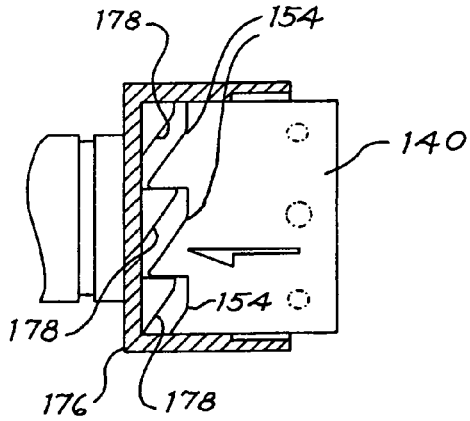
FIG. 37B is a side view of the coupling element of the clutch moving axially toward the adapter sleeve such that the plurality of cogs of the coupling element engage the plurality of cogs of the adapter sleeve in accordance with another preferred embodiment of the invention.

A second end portion of the coupling element 140 proximate to the adapter sleeve 176 has a plurality of cogs 154 disposed at the outer surface facing the adapter sleeve 176. The plurality of cogs 154 may be configured to contact and engage a plurality of cogs 178 provided on one facing side of the adapter sleeve 176 for engaging the clutch 130 to the adapter sleeve 176. As shown in FIGS. 36B and 37B, the coupling element 140 can move axially, driven by the rotation of the cord drum 128 and the interaction between the radial stud 152 and the guide track 156, for causing the plurality of cogs 154 of the coupling element 140 to engage with or disengage from the plurality of cogs 178 of the adapter sleeve 176. The clutch 130 is turned to the coupled state when the plurality of cogs 154 of the coupling element 140 engage with the plurality of cogs 178 of the adapter sleeve 176, and is turned to the uncoupled state when the plurality of cogs 154 of the coupling element 140 disengage from the plurality of cogs 178 of the adapter sleeve 176.

Figure 31A:
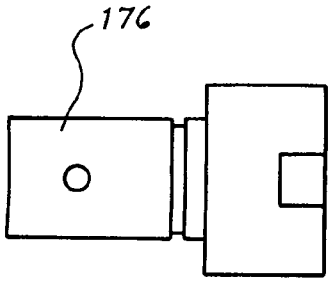
FIG. 31A is a side view of an adapter sleeve of the control module in accordance with another preferred embodiment of the invention.
Figure 31B:
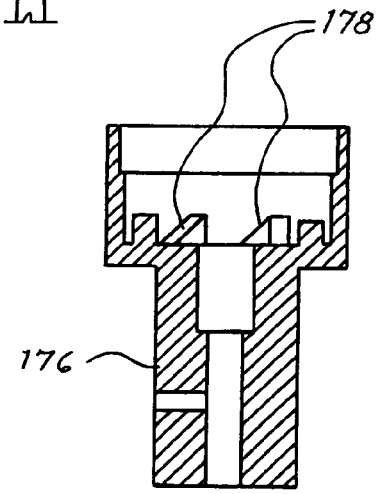
FIG. 31B is a top view the adapter sleeve of the control module of FIG. 31A in accordance with another preferred embodiment of the invention.
Figure 31C:
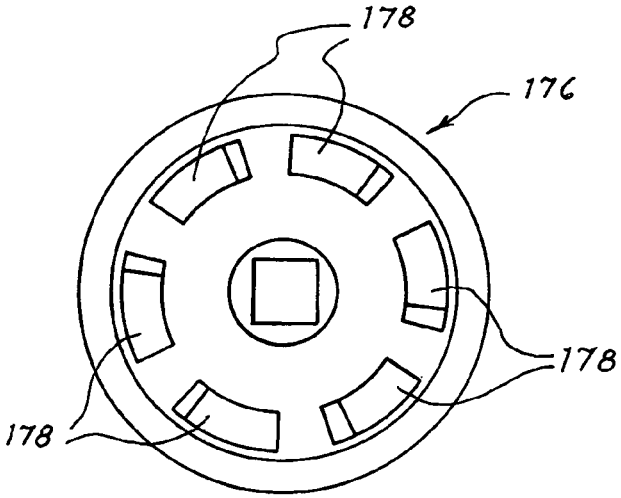
FIG. 31C is front view of the adapter sleeve of the control module of FIG. 31A in accordance with another preferred embodiment of the invention.

Referring to FIGS. 31A-31C, the adapter sleeve 176 is preferably generally cylindrical and is affixed around the drive axle 118 such that both the adapter sleeve 176 and the drive axle 118 rotate in unison. The adapter sleeve 176 includes a central hole 177 and a plurality of cogs 178 formed at one end of the adapter sleeve 176. The plurality of cogs 178 of the adapter sleeve 176 are configured to engage with the corresponding plurality of cogs 154 of the coupling element 140 during operation. Once the clutch 130 is rotated to a coupled state, the coupling element 140 is positioned through the central hole 177 of the adapter sleeve 176, such that the plurality of cogs 154 of the coupling element 140 mate with the plurality of cogs 178 of the adapter sleeve 176. As shown, each of the cogs 154 and 178 can have a triangular cross-section such that they can engage with each other when the coupling element 140 rotates in one direction, and easily disengage from each other when the coupling element 140 rotates in a reverse direction.

When the clutch 130 is in the uncoupled state, the plurality of cogs 154 of the coupling element 140 are disengaged from the plurality of cogs 178 of the adapter sleeve 176 for permitting relative movements between the drive axle 118 and the cord drum 128, e.g., the drive axle 118 and adapter sleeve 176 can rotate for lowering the bottom rail 116 independent from the cord drum 128 kept stationary, or the cord drum 128 can rotate for winding the operating cord 120 independent from the drive axle 118 locked in position. For turning the clutch 130 from the uncoupled state to the coupled state, the cord drum 128 can be rotated by pulling on the operating cord 120, which causes the coupling element 140 to rotate and then axially shift in a direction toward the adapter sleeve 176 owing to the radial stud 152 moving into the second section 156*b* of the guide track 160. As a result, the plurality of cogs 154 of the coupling element 140 moves toward and engage the plurality of cogs 178 of the adapter sleeve 176, thereby turning the clutch 130 to the coupled state. Consequently, rotational movement of the cord drum 128 can be transmitted through the coupling element 140 to the adapter sleeve 176 and drive axle 118. Still, in another example, the adapter sleeve may be removed and the clutch 130 may be adapted to transmit rotational movement from the cord drum 128 directly to the drive axle 118.

Figure 34:
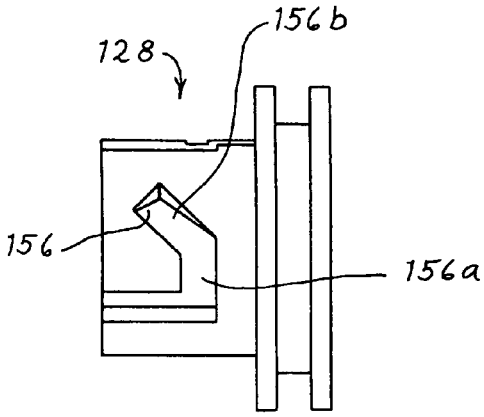
FIG. 34 is a side view a cord drum assembly of the control module having an outer surface having at least one guide track configured to engage the clutch in accordance with another preferred embodiment of the invention.

Referring to FIG. 34, the cord drum 128 may be generally cylindrical and pivotally assembled around the stationary rod 149, at a position adjacent to one side of the coupling element 140 that is opposite the side of the coupling element 140. The cord drum 128 is connected with the operating cord 120 and is operable to rotate for winding the operating cord 120 around the cord drum 128. The cord drum 128 is also configured to engage the clutch 130 for connection to the drive axle 118. The cord drum 128 preferably includes at least one guide track 156 that can engage the corresponding at least one stud 152 of the coupling element 140 for driving rotating and axial movements of the clutch 130. Alternatively, the cord drum 128 will have at least three guide tracks for engaging at least three studs of the coupling element 140. Still, it will be appreciated that the guide track 156 and stud 152 may be switched and the cord drum 128 may include at least one stud configured to engage a guide track of the coupling element.

Figure 27:
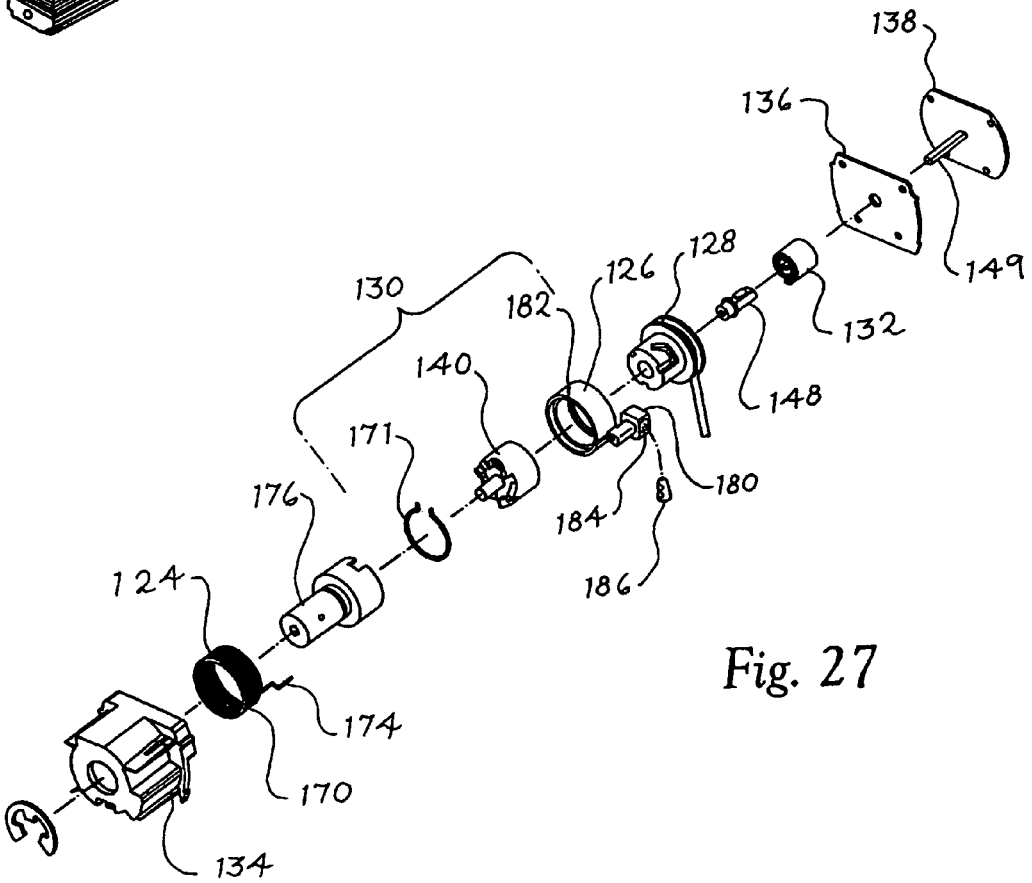
FIG. 27 is an exploded view of the control module of the window shade assembly in accordance with another preferred embodiment of the invention.
Figure 28:
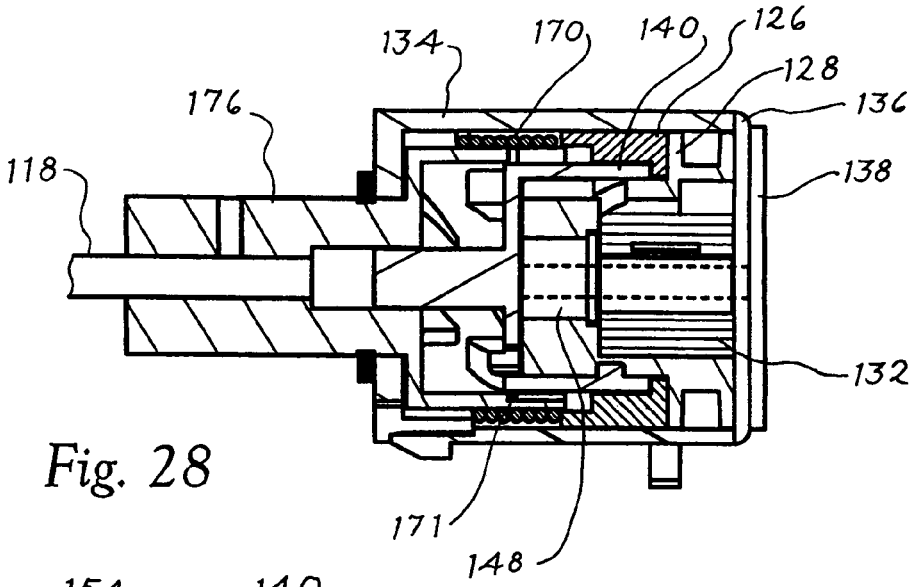
FIG. 28 is a side view of the control module in accordance with another preferred embodiment of the invention.

Referring to FIGS. 27 and 28, the cord drum 128 is coupled with the motor mechanism 132, which is configured to drive rotation of the cord drum 128 in a direction to wind the operating cord 120 thereon. The motor mechanism 132 can be a torsion spring that is assembled through an inner cavity of the cord drum 128, the torsion spring having a first end affixed on the stationary rod 149 and a second end affixed with the cord drum 128. Alternatively, the motor mechanism 132 may be located externally of the control module 122 and used to drive the reverse rotation of the cord drum 128. In this example, the motor mechanism 132 may be a motor device separate from the control module 122 but still operatively connected to the cord drum 122 to drive the reverse rotation of the cord drum 122.

Figure 30:
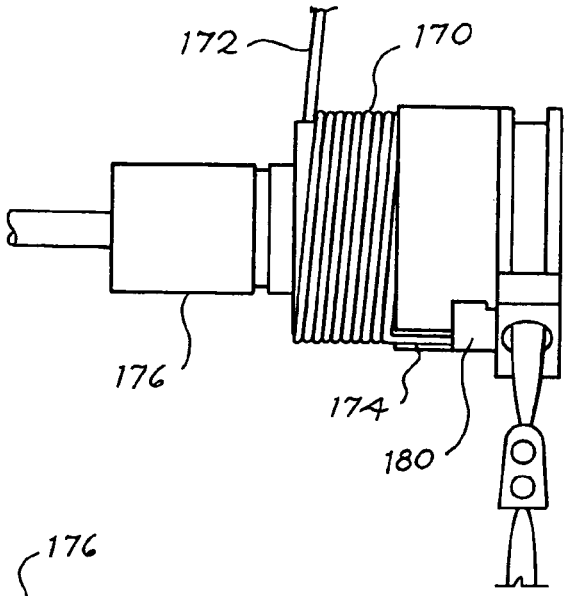
FIG. 30 is a side view of a brake mechanism of the control module in accordance with another preferred embodiment of the invention.

Referring to FIGS. 27, 28 and 30, the brake mechanism 124 is mounted around the drive axle 118, and is operable to either tighten and lock the drive axle 118 in position, or loosen and unlock the drive axle 118 for allowing rotation in either direction. In the illustrated embodiment, the brake mechanism 124 may include a spring element 170, such as a torsion spring. The spring element 170 has a generally cylindrical shape and is configured with spring-like characteristics permitting tightening or loosening depending on the circumstances. The spring element 170 is mounted at the drive axis and includes a first prong 172 and a second prong 174. The first prong 172 extends outward from the spring element 170 and is anchored with the housing 134, whereas the second prong 174 extends outward from the spring element 170 and is anchored with the brake release 126 operable by a user.

Figure 32:
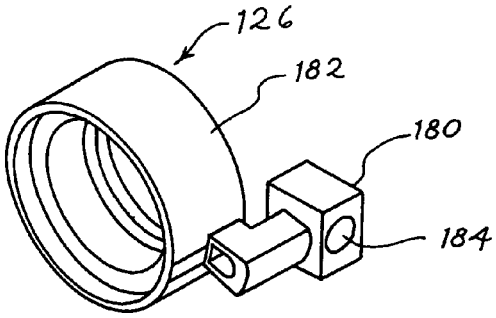
FIG. 32 is perspective view brake release of the control module in accordance with another preferred embodiment of the invention.
Figure 33:
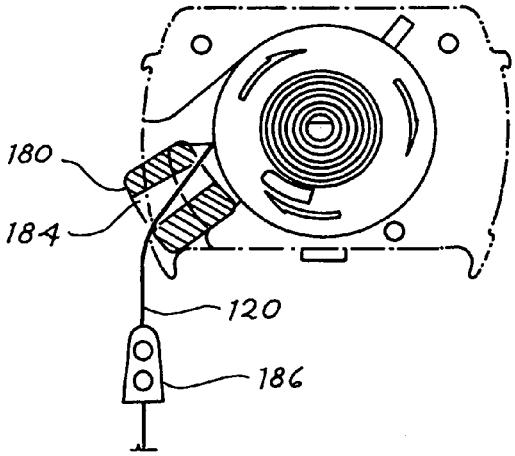
FIG. 33 is side view brake release of the control module in accordance with another preferred embodiment of the invention.

Referring to FIGS. 32 and 33, the brake release 26 can be operable to lock and unlock the brake mechanism 124. In one embodiment, the brake release 126 can include a generally cylindrical collar portion 182, and a release actuator crank 180 connected with the collar portion 182 at an eccentric position and securely joined with the second prong 174 of the spring element 170. The collar portion 182 can be mounted coaxial to the drive axis of the drive axle 118, but is independent from the movement of the drive axle 118. In the illustrated embodiment, the collar portion 182 is exemplary assembled around a portion of the coupling element 140 with the release actuator crank 180 extending generally parallel to the drive axis of the drive axle 118. When the brake release 126 is in the locked position, the release actuator crank 80 biased by the spring element 170 is located at a relatively higher position, and the spring element 170 of the brake mechanism 124 can tighten and lock the drive axle 118 in position. When the brake release 126 is pulled downward to a release position, the release actuator crank 180 is shifted to a relatively lower position, which also pulls the second prong 174 in a direction to loosen the spring element 170 and unlock the drive axle 118, thereby allowing the drive axle 118 to rotate.

A bore 184 may also be provided at an end portion of the release actuator crank 180 and configured to receive a release mechanism for actuating the brake release 126. At least a portion of the operating cord 120 may movably pass through the bore 184 and a stop plug 186 fixedly attached on the operating cord 120 may engage with the bore 184. While the stop plug 186 is engaged with the bore 184, a user may gently pull the operating cord 120 to move the brake release 126 to the release position to unlock the drive axle 118.

While the operating cord 120 is not being manipulated by the user, the window shade 114 is locked in a fixed position. In this position, the spring element 170 of the brake mechanism tightens on the adapter sleeve 176, which blocks rotation of the drive axle 118. Alternatively, the adapter sleeve 176 may be removed and the spring element 170 may tighten directly around the drive axle 118 to block the rotation thereof.

Figure 35:
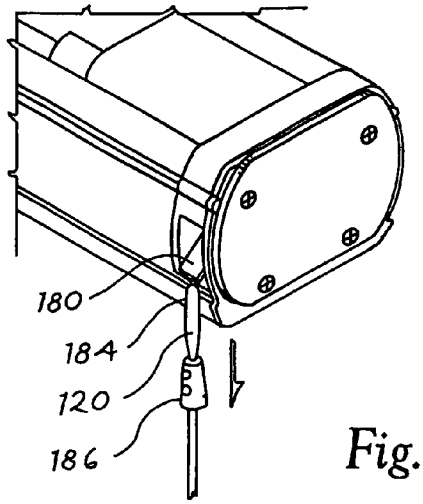
FIG. 35 is a perspective view brake release of the control module having a locked up position and an unlocked down position in accordance with another preferred embodiment of the invention.

As shown in FIG. 35, when the user wants to lower the bottom rail 116, the operating cord 120 can be gently pulled downward to move the brake release 126 to the release position and cause the spring element 170 to loosen. The brake release 126 may be moved to the release position by biasing the release actuator crank 180 to a down position. In the illustrated example, the release actuator crank 180 can be moved to the down position by slightly pulling the operating cord 120 downward, the movement of which is transmitted to the release actuator crank 180 via engagement between the stop plug 186 and the bore 184. In other embodiments, the release actuator crank 180 can also be moved to the down position by pulling downward a control stick 87 that is separate from the operating cord 120 and connected with the release actuator crank 180. With the stop plug 186 remaining engaged with the bore 184 and the brake release 126 kept in the release position, the unlocked drive axle 118 can rotate in a direction that unwinds the suspension cords attached with the bottom rail 116, driven by the weight of the bottom rail 116 and window shade 114 stacked thereon. While the drive axle 118 and adapter sleeve 176 rotate for lowering the bottom rail 116, the split ring 171 can provide some degree of rotational resistance to the coupling element 140 as the split ring 171 tightens around the coupling element 140. As a result, the coupling element 140 remains disengaged from the rotating adapter sleeve 176, and the clutch 130 can be kept in the uncoupled state.

Once the bottom rail 116 moving downward reaches the desired height, the brake release 126 biased by the spring element 170 can be moved to the locked position, and the spring element 170 can recover its initial state and tighten around the adapter sleeve 176, thereby locking the drive axle 118 and the adapter sleeve 176 in position and allowing the bottom rail 116 to be locked at the desired height.

Referring to FIGS. 36A-38B, when the user wants to raise the bottom rail 116, the operating cord 120 can be pulled downward causing the brake release 126 to move to the release position and unlock the drive axle 118 and adapter sleeve 176. Once the brake release 126 is in the release position, further downward pulling of the operating cord 120 forces the stop plug 186 to dislodge from the bore 184, and causes the operating cord 120 to unwind from the cord drum 128 and slide through the bore 184. As shown in FIG. 36A-37B, as the cord drum 128 rotates in a direction that unwinds the operating cord 120, the radial stud 152 of the coupling element 140 shifts from a first abutment position in the first section 156*a* to a second abutment position in the second section 156*b* of the guide track 156, causing the coupling element 140 to move in an axial direction toward the adapter sleeve 176. Once the radial stud 152 has reached the second abutment position in the second section 156*b* of the guide track 156, the plurality of cogs 154 of the coupling element 140 engage the plurality of cogs 178 of the adapter sleeve 176 to turn the clutch 130 to the coupled state. Consequently, further rotation of the cord drum 128 can be transmitted from the cord drum 128 to the clutch 130 via the abutment position of the radial stud 152 in the guide track 156, and from the clutch 130 to drive axle 118 via engagement between the plurality of cogs 154 of the coupling element 140 and the plurality of cogs 178 of the adapter sleeve 176. The bottom rail 116 can be thereby raised by rotation of the cord drum 128 driven by pulling down the operating cord 120.

The user may release the operating cord 120 at any particular time, such as when the bottom rail 116 has reached a desired height or after the operating cord 120 has been fully extended. In response, the spring element 170 returns to its tightened configuration and tightly holds around the adapter sleeve 176, while the release actuator crank 180 of the brake release 126 moves upward to its initial locked position. The tightened configuration of the spring element 170 securely locks and blocks rotation of the adapter sleeve 176 and drive axle 118. As a result, both the adapter sleeve 176 and drive axle 118 are fixed and the window shade 114 is locked in position at the desired height. Meanwhile, the motor spring 132 drives reverse rotation of the cord drum 128 thereby causing the operating cord 120 to retract and wind about the cord drum 128. Referring to FIGS. 37A-37B, as the cord drum 128 rotates in a reverse direction, the radial stud 152 is shifted from the second abutment position in the second section 156*b* to the first abutment position in the first section 156*a* of the guide track 156, causing the plurality of cogs 154 of the coupling element 140 to disengage from the plurality of cogs 178 of the adapter sleeve 176. As a result, the clutch 130 can be turned to the uncoupled state. While the clutch 130 is in the uncoupled state, the motor mechanism 132 further drives reverse rotation of the cord drum 128 with the coupling element 140 for winding the operating cord 128, independent of the adapter sleeve 176 locked by the spring element 170. The coupling element 140 and the cord drum 128 continue to rotate together independent of the adapter sleeve 176 as the operating cord 120 is continuously wound until the stop plug 186 contacts and engages the bore 184 of the release actuator crank. Locked by the spring element 170, the adapter sleeve 176 and drive axle 118 are kept stationary, as the coupling element 140 and the cord drum 128 rotate for winding the operating cord 120. Since the adapter sleeve 176 is not engaged with the coupling element 140 and the cord drum 128, the drive axle 118 does not move and the bottom rail 116 and window shade 114 can be locked in position as the operating cord 120 is would around the cord drum 128. Once the winding is at least partially complete, the user may again pull the operating cord 120 in a downward direction to further lift the window shade 114. This process may be repeated until the window shade 114 reaches the desired height.

Figure 22:
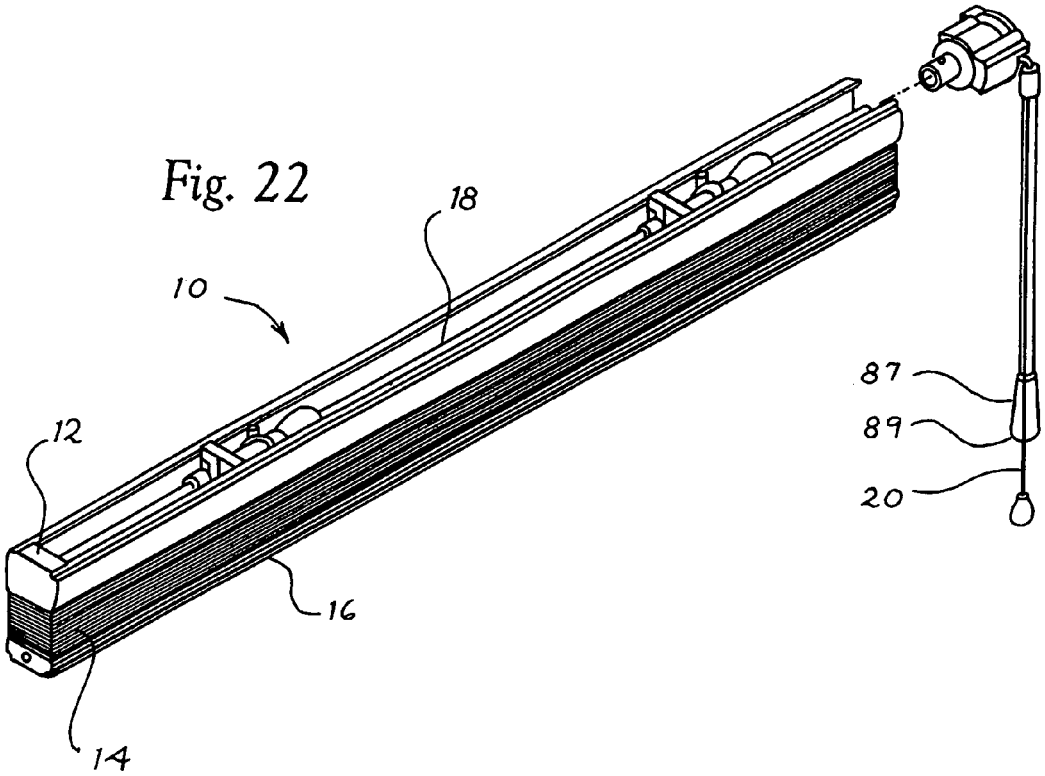
FIG. 22 is a perspective view of a window shade assembly having a control stick for use with a control module in accordance with another preferred embodiment of the invention.
Figure 23A:
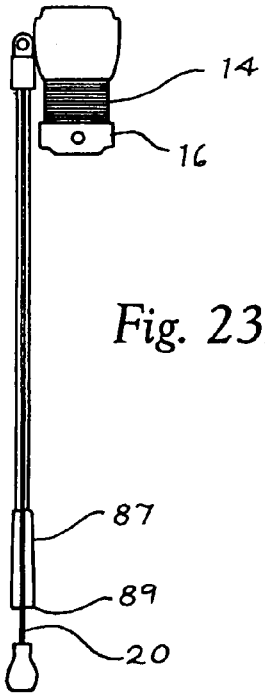
FIG. 23A is a side view of the window shade assembly of FIG. 22 where a bottom rail of the window shade assembly is at a raised position.
Figure 23B:
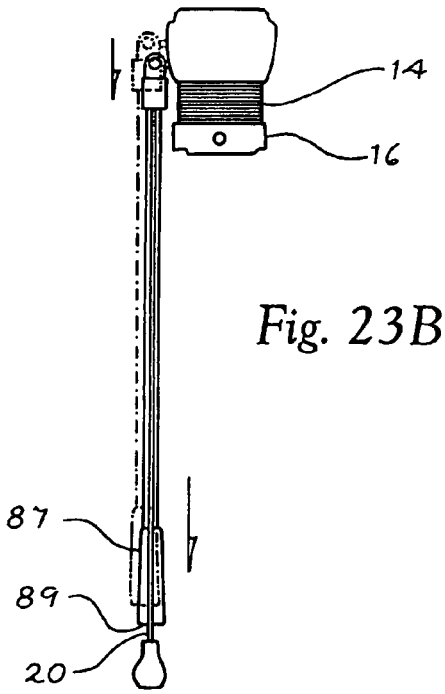
FIG. 23B is a side view of the window shade assembly of FIG. 22 showing the control stick moving a brake release from the locked up position to the release down position.
Figure 23C:
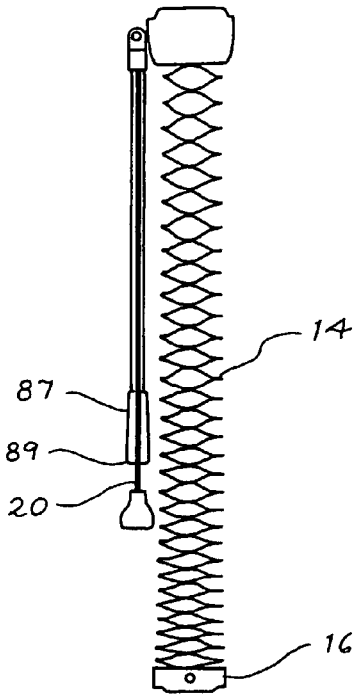
FIG. 23C is a side view of the window shade assembly of FIG. 22 where the bottom rail of the window shade assembly is at a lowered position.
Figure 23D:
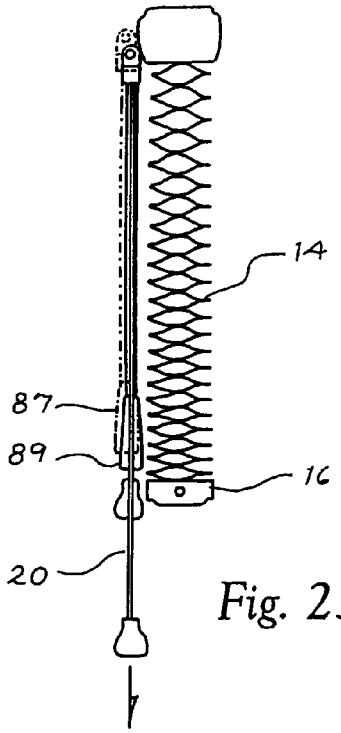
FIG. 23D is a side view of the window shade assembly of FIG. 22 showing an operating cord used for raising the bottom rail.
Figure 24:
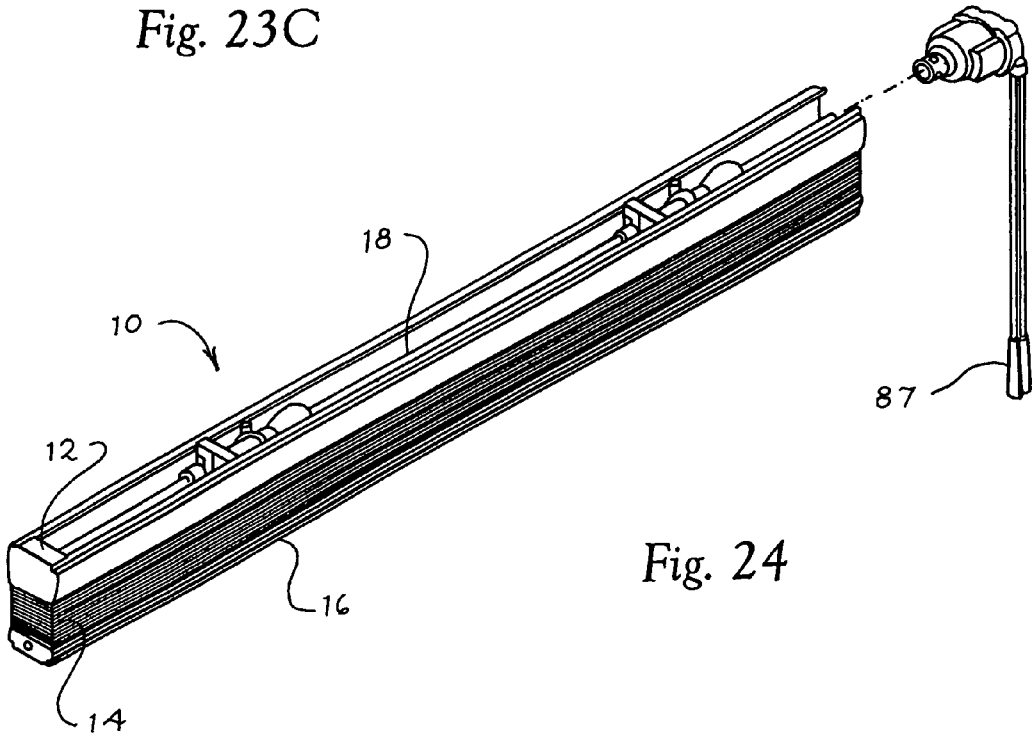
FIG. 24 is a perspective view of a window shade assembly having a control stick for use with a control module in accordance with another preferred embodiment of the invention.

Similar to that discussed above, additional embodiments for FIGS. 26-38 may include the control stick 87 used to lower the bottom rail 116 as shown in FIGS. 22-23C. The control stick 87 may be connected to the release actuator crank 80 for releasing the brake release 26 and may have a generally hollow structure. As shown in FIG. 23D, the operating cord 20 passes through the hollow interior of the control stick 87 and can be pulled for raising the bottom rail 116.

Similar to that discussed above, another additional embodiment for FIGS. 26-38 may include the control stick 87 used for both lowering and raising the bottom rail 116. As shown in FIGS. 24 and 25A-25D, the control stick 87 may be coupled at a lower end 91 of the operating cord 20 proximate to the stop plug 86. As discussed above, a user may lower the bottom rail 116 by gently pulling on the control stick 87 and may raise the bottom rail 116 by continuously pulling on the control stick 87.

The foregoing description and the drawings are illustrative of the present invention and not to be taken as limiting. Other arrangements of the engagement structure may be implemented. Such variations and modifications are within the spirit and the scope of the present invention and will be readily apparent to those skilled in the art in view of the scope of the invention as claimed herein.

We claim:

1. A control module adapted for being operatively connected to an axle of a window shade having a motor mechanism on the axle, the control module being operable to raise and lower the window shade, the control module comprising:

a brake mechanism mounted with the axle and having a locking state and an unlocking state;

a brake release operably connected to the brake mechanism and movable between a first position corresponding to the locking state of the brake mechanism and a second position corresponding to the unlocking state of the brake mechanism;

a cord drum adapted to be selectively connected to the axle and operably connected to the motor mechanism; and a clutch adapted to be mounted on the axle, the clutch having a coupled state in which the clutch rotationally couples with the cord drum and the axle such that the cord drum and the axle are operable to rotate in unison to raise the window shade, and an uncoupled state in which the cord drum and the axle are operable to rotate independently relative to each other, wherein the clutch comprises:

a first coupling element having a guide track and coaxially assembled with a second coupling element, the first coupling element adapted to operatively engage the cord drum; the first and second coupling elements configured to rotate with respect to each other to form a first configuration corresponding to the uncoupled state of the clutch and a second configuration corresponding to the coupled state of the clutch; and a track member rotationally coupled with the axle and movable along the guide track;

wherein the track member is movable along the guide track when the first and second coupling elements are in the first configuration, and wherein the track member engages the first and second coupling elements when the first and second coupling elements are in the second configuration such that rotational movement of the coupling elements is transmissible to the axle and the cord drum.

2. The control module of claim 1 including an operating cord wrapped around the cord drum.

3. The control module of claim 2 wherein the operating cord is operably connected to the brake release such that partial unwinding of the cord unlocks the brake mechanism.

4. The control module of claim 1 wherein the clutch further comprises at least one radial abutment at the first coupling element for engaging at least one radial rib at the second coupling element.

5. The control module of claim 1 wherein the brake mechanism further comprises a spring element adapted to be circumscribed about the axle and secured to the brake release by at least a flange portion extending outwardly from the spring element to the brake release.

6. The control module of claim 5 wherein the spring element is adapted to tighten around the axle to lock rotation of the axle.

7. The control module of claim 1 wherein a control stick is operably connected to the brake release such that downward movement of the control stick unlocks the brake mechanism.

8. The control module of claim 7 including an operating cord wrapped around the cord drum and at least partially enclosed within a hollow cavity of the control stick.

9. A control module adapted for being operatively connected to an axle of a window shade having a motor mechanism on the axle, the control module being operable to raise and lower the window shade, the control module comprising:

a brake mechanism mounted with the axle and having a locking state and an unlocking state;

a brake release operably connected to the brake mechanism and movable between a first position corresponding to the locking state of the brake mechanism and a second position corresponding to the unlocking state of the brake mechanism;

a cord drum adapted to be selectively connected to the axle and operably connected to the motor mechanism; and a clutch adapted to be mounted on the axle, the clutch having a coupled state in which the clutch rotationally couples with the cord drum and the axle such that the cord drum and the axle are operable to rotate in unison to raise the window shade, and an uncoupled state in which the cord drum and the axle are operable to rotate independently relative to each other, wherein the clutch comprises:

a coupling element assembled around the axis of the axle and having a collar portion adapted to mount around the cord drum, the coupling element having a first plurality of cogs and an inner surface provided with at least one stud for movably interacting with; and an adapter sleeve affixed with the axle and having a second plurality of cogs;

wherein the coupling element is movable along the axle to displace the first plurality of cogs either toward or away from the second plurality of cogs, the first plurality of cogs being engaged with the second plurality of cogs when the clutch is in the coupled state, and the first plurality of cogs being disengaged from the second plurality of cogs when the clutch is in the uncoupled state.

10. A control module adapted for being operatively connected to an axle of a window shade to raise and lower the window shade, the control module comprising:

a cord drum adapted to be selectively connected to the axle;

a motor mechanism adapted to be mounted to the axle for driving rotation of the cord drum;

a brake mechanism adapted to be circumscribed about the axle and having a locking state and an unlocking state;

a brake release disposed along the drive axle for movement between a first position corresponding to the locking state of the brake mechanism and a second position corresponding to the unlocking state of the brake mechanism;

an operating cord wrapped around the cord drum wherein partial unwinding of the operating cord from the cord drum drives the brake mechanism to the unlocking state and rotates the cord drum; and a clutch adapted to be mounted on the axle, the clutch having a first coupling element and a second coupling element, the first and second coupling elements rotationally movable relative to each other to form a first configuration corresponding to an uncoupled state of the clutch and a second configuration corresponding to a coupled state of the clutch, wherein unwinding of the operating cord from the cord drum drives the clutch to the coupled state so that the cord drum and the axle are rotationally coupled with each other; and wherein the first coupling element comprises a guide track in which is received a track member, the guide track running around the axle, and the track member being rotationally coupled with the axle and movable along the guide track.

11. The control module of claim 10 wherein the first coupling element further comprises at least one radial abutment and the second coupling element further comprises at least one radial rib, wherein at least one of the at least one radial abutment engages the at least one radial rib.

12. The control module of claim 10 wherein the brake release is operably connected to the cord drum.

13. The control module of claim 10 wherein partial unwinding of the operating cord from the cord drum drives the brake release to move to the second position to turn the brake mechanism to the unlocking state.

14. A window shade assembly comprising:

a head rail;

a bottom rail;

a window shade;

a rotatable drive axle disposed within the head rail along a drive axis and connected to the window shade for raising or lowering the window shade;

a control module disposed in the head rail and comprising:

a housing configured to receive a portion of the drive axle, the housing comprising exterior sidewalls and an opening for the drive axle;

an adapter sleeve fixed to the drive axle;

a brake mechanism mounted around the adapter sleeve and having a locking state and an unlocking state;

a brake release a brake release comprising a cylindrical collar portion mounted coaxial with the drive axle and including a release acuator crank having a bore at an end portion and being operably connected to the brake mechanism, the brake release being movable between a first position corresponding to the locking state of the brake mechanism and a second position corresponding to the unlocking state of the brake mechanism;

a cord drum disposed along the drive axis;

an operating cord associated with the brake release, the operating cord being movably passing through the bore of the release actuator crank and having a stop plug fixedly attached thereto so as to engage the bore such that the operating cord is operable to move the brake release to the second position and to rotate the cord drum;

a motor mechanism operatively connected to the cord drum, the motor mechanism being operable to drive rotation of the cord drum for winding the operating cord thereon; and a clutch operable to rotationally engage with the cord drum, the clutch having a coupled state in which the clutch is rotationally coupled with the cord drum and the adapter sleeve to raise the window shade, and an uncoupled state in which the cord drum and the adapter sleeve are capable of rotating independently of each other.

15. The window shade assembly of claim 14 wherein the brake mechanism has a first flange portion extending in a outward direction and secured to the housing and a second flange portion extending in an outward direction and secured to the brake release.

16. The window shade assembly of claim 14 wherein the clutch further comprises:

a first coupling element having a guide track coaxially assembled with a second coupling element, the first coupling element being adapted to engage with the cord drum, the guide track running around the axis of the axle, and the first and second coupling elements configured to rotate with respect to each other to form a first configuration corresponding to the uncoupled state of the clutch and a second configuration corresponding to the coupled state of the clutch; and a track member rotationally coupled with the adapter sleeve and movable along the guide track;

wherein the track member is movable along the guide track when the first and second coupling elements are in the first configuration, and wherein the track member engages the first and second coupling elements when the first and second coupling elements are in the second configuration such that rotational movement is transmissible between the axle and cord drum via the first and second coupling elements.

17. The window shade assembly of claim 16 wherein the adapter sleeve has a radial slot for receiving the track member.

18. The window shade assembly of claim 14 wherein the clutch is adapted to move in an axial direction to engage with and disengage from the adapter sleeve.

19. The window shade assembly of claim 14 wherein the clutch further comprises:

a coupling element assembled around the axle and having a collar portion adapted to mount around the cord drum, the coupling element having a first plurality of cogs and an inner surface provided with a stud;

wherein the adapter sleeve has a second plurality of cogs, and the coupling element is movable along the axle to displace the first plurality of cogs either toward or away from the second plurality of cogs, the first plurality of cogs being engaged with the second plurality of cogs when the clutch is in the coupled state, and the first plurality of cogs being disengaged from the second plurality of cogs when the clutch is in the uncoupled state.

20. The window shade assembly of claim 14 wherein the brake release further comprises a bore configured to receive a release mechanism for rotating the brake release to the first position and second position.

21. The window shade assembly of claim 14 wherein the operating cord has a length less than half of the length of the window shade.

* * * * *

UNITED STATES PATENT AND TRADEMARK OFFICE

CERTIFICATE OF CORRECTION

PATENT NO. : 8,356,653 B2
APPLICATION NO. : 12/806984
DATED : January 22, 2013
INVENTOR(S) : Fu-Lai Yu et al.

It is certified that error appears in the above-identified patent and that said Letters Patent is hereby corrected as shown below:

IN THE SPECIFICATION:

Column 7, line 58, delete "14" and insert --28--
Column 7, line 59, delete "10" and insert --20--
Column 12, line 60, delete "20" and insert --28--
Column 14, line 61, delete "160" and insert --156--

CLAIMS:

Column 19, line 38 (Claim 9) after "interacting with" insert --the cord drum--

Signed and Sealed this
Twenty-fifth Day of June, 2013

Teresa Stanek Rea
*Acting Director of the United States Patent and Trademark Office*